US009848712B2

(12) United States Patent
Main et al.

(10) Patent No.: US 9,848,712 B2
(45) Date of Patent: Dec. 26, 2017

(54) BEDDING SYSTEM WITH SUPPORT SURFACE CONTROL

(71) Applicant: XSENSOR Technology Corporation, Calgary (CA)

(72) Inventors: Ian Main, Calgary (CA); Timothy Carl Gorjanc, Calgary (CA); Robert Miller, Calgary (CA); Chris Cooper, Vancouver (CA)

(73) Assignee: Xsensor Technology Corporation, Calgary (CA)

( * ) Notice: Subject to any disclaimer, the term of this patent is extended or adjusted under 35 U.S.C. 154(b) by 780 days.

(21) Appl. No.: 13/873,609

(22) Filed: Apr. 30, 2013

(65) Prior Publication Data

US 2013/0283530 A1 Oct. 31, 2013

Related U.S. Application Data

(60) Provisional application No. 61/640,648, filed on Apr. 30, 2012.

(51) Int. Cl.

| | |
|---|---|
| ***A47C 31/12*** | (2006.01) |
| ***A47C 27/08*** | (2006.01) |
| ***A47C 27/10*** | (2006.01) |

(52) U.S. Cl.

CPC ..... *A47C 31/12* (2013.01); *A47C 27/083* (2013.01); *A47C 27/10* (2013.01); *A47C 31/123* (2013.01)

(58) Field of Classification Search

CPC ..... A47C 31/12; A47C 31/123; A47C 27/083; A47C 27/10

See application file for complete search history.

(56) References Cited

U.S. PATENT DOCUMENTS

| | | | | |
|---|---|---|---|---|
| 6,280,392 | B1 * | 8/2001 | Yoshimi | A61B 5/1116 600/529 |
| 7,107,642 | B2 | 9/2006 | Wong et al. | |
| 2002/0184711 | A1 * | 12/2002 | Mahoney | A47C 27/082 5/713 |
| 2010/0174198 | A1 * | 7/2010 | Young | A47C 27/144 600/484 |

(Continued)

FOREIGN PATENT DOCUMENTS

| | | | |
|---|---|---|---|
| CN | 101803983 | A | 8/2010 |
| WO | WO 2009/102361 | A1 | 8/2009 |

(Continued)

OTHER PUBLICATIONS

Bayer L., et al., "Rocking synchronizes brain waves during a short nap," Current Biology, 2011, pp. R461-R462, vol. 21, No. 12.

(Continued)

*Primary Examiner* — David E Sosnowski
*Assistant Examiner* — Amanda L Miller
(74) *Attorney, Agent, or Firm* — Fenwick & West LLP

(57) ABSTRACT

A bedding system uses machine vision to makes adjustments for comfort and/or support. In one aspect, a pressure mapping engine measures a two-dimensional pressure image of a sleeper on the bedding system while the sleeper is sleeping on the bedding system. A machine vision process analyzes the pressure image. A comfort and support engine adjusts a comfort and/or support of the bedding system based on the machine vision analysis.

27 Claims, 27 Drawing Sheets

(56) References Cited

U.S. PATENT DOCUMENTS

| | | | | |
|---|---|---|---|---|
| 2010/0318239 | A1* | 12/2010 | Oexman | A47C 23/0433 700/301 |
| 2011/0010014 | A1* | 1/2011 | Oexman | A47C 27/061 700/276 |
| 2011/0308019 | A1 | 12/2011 | Terawaki et al. | |
| 2013/0006151 | A1 | 1/2013 | Main et al. | |
| 2013/0144751 | A1* | 6/2013 | Gorjanc | A47C 31/123 705/26.7 |
| 2013/0283530 | A1* | 10/2013 | Main | A47C 31/123 5/600 |

FOREIGN PATENT DOCUMENTS

| | | | |
|---|---|---|---|
| WO | WO 2011/066151 | A1 | 6/2011 |
| WO | WO 2011/091517 | A1 | 8/2011 |

OTHER PUBLICATIONS

Fronczek, R., et al., "Manipulation of Core Body and Skin Temperature Improves Vigilance and Maintenance of Wakefulness in Narcolepsy," Sleep, 2008, pp. 233-240, vol. 31, No. 2.

Machiel Van Der Loos, H.F. et al., "Development of Sensate and Robotic Bed Technologies for Vital Signs Monitoring and Sleep Quality Improvement," Autonomous Robots, 2003, pp. 67-79, vol. 15.

Malakuti, K., "Towards an Intelligent Bed Sensor: Non-Intrusive Monitoring of Sleep Disturbances via Computer Vision Techniques," Thesis, University of Victoria, 2008, 93 pages.

Raymann, R., et al., "Skin deep: enhanced sleep depth by cutaneous temperature manipulation," Brain, 2008, pp. 500-513, vol. 131.

Yousefi, R. et al., "Bed Posture Classification for Pressure Ulcer Prevention," 2011 Annual International Conference of the IEEE, Engineering in Medicine and Biology Society, EMBC, Aug. 30, 2011-Sep. 3, 2011, pp. 7175-7178.

Yousefi, R. et al., "A Smart Bed Platform for Monitoring & Ulcer Prevention," 2011 4th International Conference on Biomedical Engineering and Informatics (BMEI), IEEE, 2011, pp. 1362-1366.

PCT International Search Report and Written Opinion for PCT/182013/001276, dated Sep. 17, 2013, 7 Pages.

Office Action for Chinese Patent Application No. CN 201180007313.4, dated Dec. 31, 2013, 17 Pages.

* cited by examiner

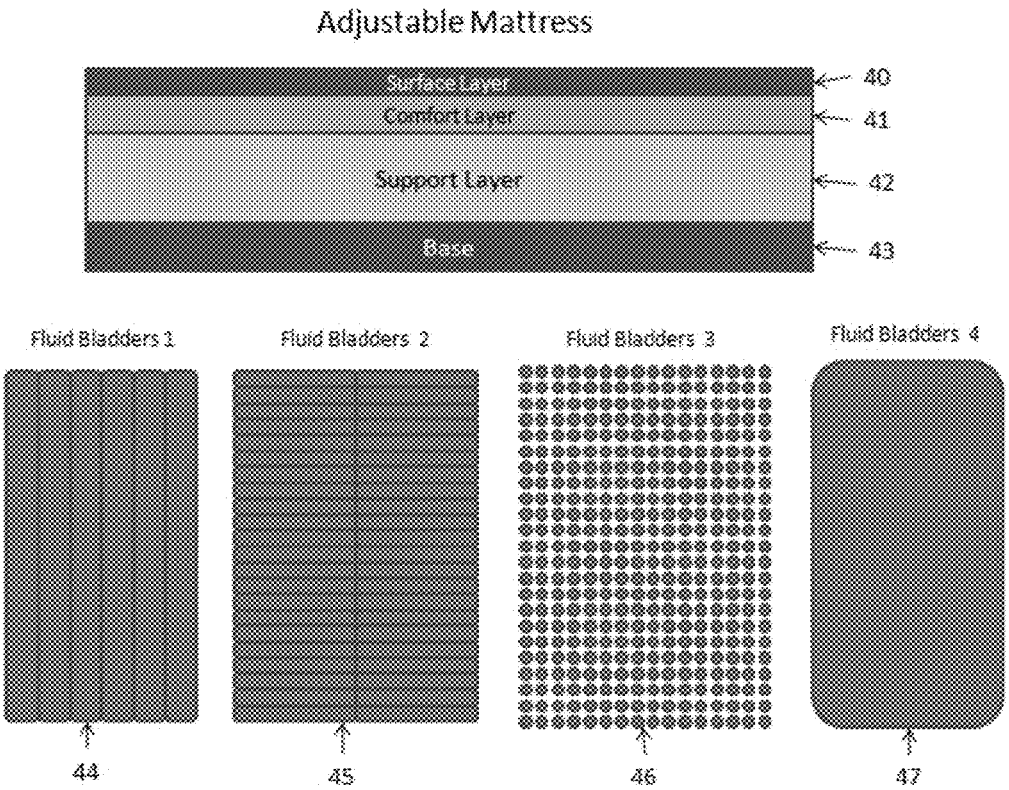

Figure 5

*Mattress size (width × length)*

| | N. America[1] | Australia[2] | UK & Ireland[3] | Continental Europe & Latin America | Japan[4] |
|---|---|---|---|---|---|
| Single<br>Twin (USA) | 39 in × 75 in<br>99 cm × 190 cm | 36 in × 74 in<br>91 cm × 190 cm | 36 in × 75 in<br>91 cm × 190 cm | 90 cm × 200 cm<br>35 in × 79 in | 97 cm × 195 cm<br>38 in × 77 in |
| Double or full | 54 in × 75 in<br>140 cm × 190 cm | 54 in × 74 in<br>140 cm × 190 cm | 54 in × 75 in<br>140 cm × 190 cm | 135 cm × 190 cm<br>53 in × 75 in | 140 cm × 195 cm<br>55 in × 77 in |
| Queen<br>King (UK & Ire.)<br>Wide Double (Japan) | 60 in × 80 in<br>150 cm × 200 cm | | 60 in × 78 in<br>150 cm × 200 cm | 160 cm × 200 cm<br>63 in × 79 in | 154 cm × 195 cm<br>61 in × 77 in |
| Olympic Queen<br>Queen (Japan) | 66 in × 80 in<br>170 cm × 200 cm | | | | 170 cm × 195 cm<br>67 in × 77 in |
| King<br>Super King (UK & Ire.) | 76 in × 80 in<br>190 cm × 200 cm | 72 in × 80 in<br>180 cm × 200 cm | 72 in × 78 in<br>180 cm × 200 cm | 180 cm × 200 cm<br>71 in × 79 in | 194 cm × 195 cm<br>76 in × 77 in |
| California King<br>King Long (Japan) | 72 in × 84 in<br>180 cm × 210 cm | | | | 194 cm × 205 cm<br>76 in × 81 in |

Figure 6

| HOW WAS YOUR SLEEP? | |
|---|---|
| Comfort (1-Excellent, 5-Poor) | 2 |
| Back Pain (1-None, 5-Severe) | 3 |
| Quality (1-Sound, 5-Restless) | 5 |
| Stiffness (1-None, 5-Sore) | 1 |
| Feeling (1-Refreshed, 5-Tired) | 4 |

Figure 8

| Sleep State | Support Layer | Comfort Layer | Temperature |
|---|---|---|---|
| Default | Stored Firmness | Stored Firmness | Stored Temp |
| Bed Entry | Decrease Firmness | Decrease Firmness | Increase |
| Deep Sleep | Stored Firmness | Stored Firmness | Decrease |
| Restless Motion | Decrease Firmness | Decrease Firmness | Increase |
| Morning Wake Up | Increase Firmness | Increase Firmness | Decrease |
| Bed Exit | Suspend Auto Adjust | Suspend Auto Adjust | Off |

Figure 10

Adjustable Pillow with Temperature control option.

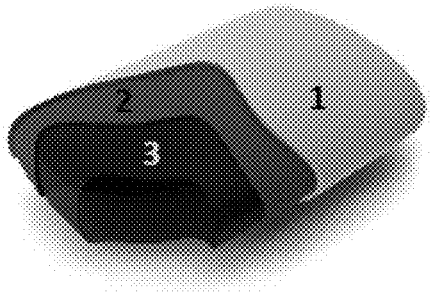

1 - Comfort Layer
- Reduces pressure points.
- Adjusted for personal preference.

2 - Temperature Layer (Optional)
- Heats or cools the pillow to sleep cycles and or personal preference.

3 - Support Layer
Adjusts height to keep spine (neck) in proper alignment.
- Options to include pressure map into pillow.
- Options to include temp control into pillow.

Figure 11a

Figure 33
109
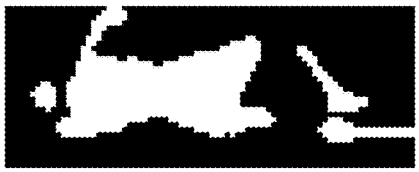
Starting image
301
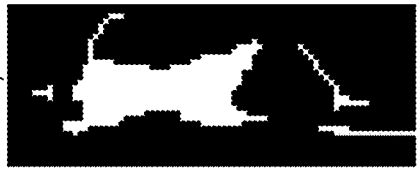
Iteration 1
302
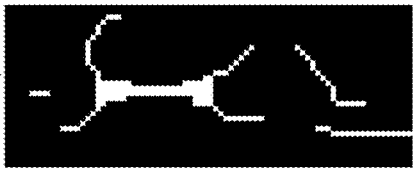
Iteration 3
204
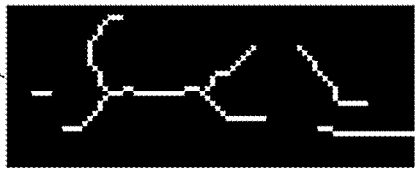
Iterations 5 (completed - further iterations have no effect)
110
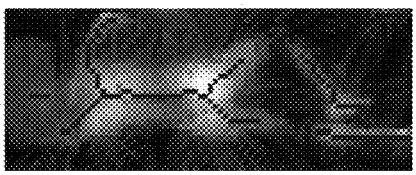
Medial Axis overlaid on original image Figure 34
401
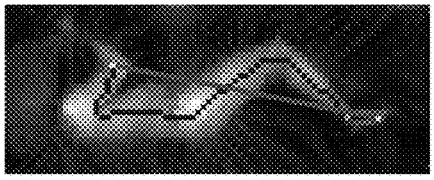
Start – 1 line segment
402
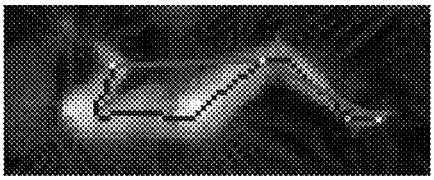
Iteration 1
403
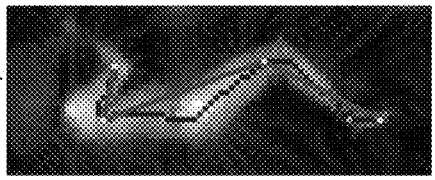
Iteration 2
404
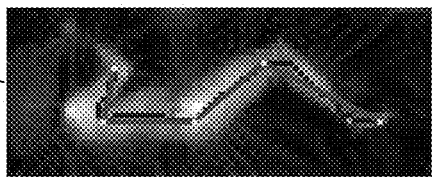
Iteration 3
405
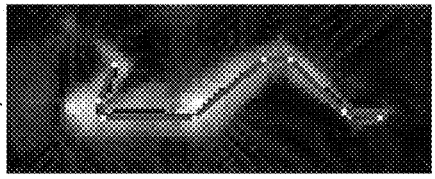
Iteration 6 – furthest distance to curve is less than maximum allowable Figure 35
111
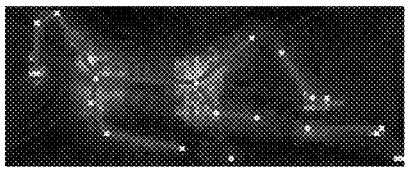
Original line segments
112
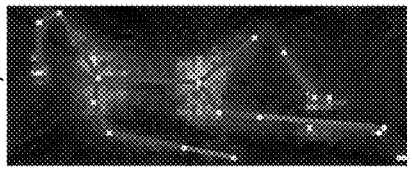
Joined line segments (in pink)

Figure 36
113
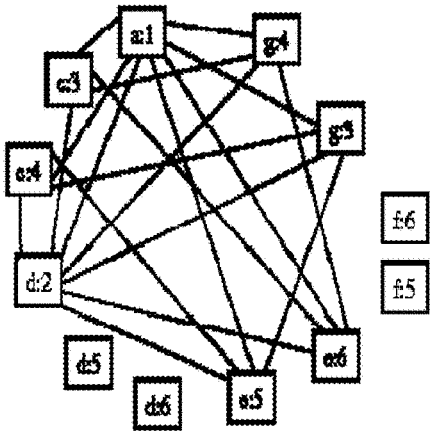
Association graph
601
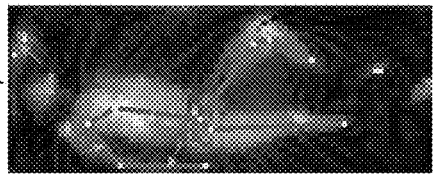
Forearm candidates

Figure 37
701
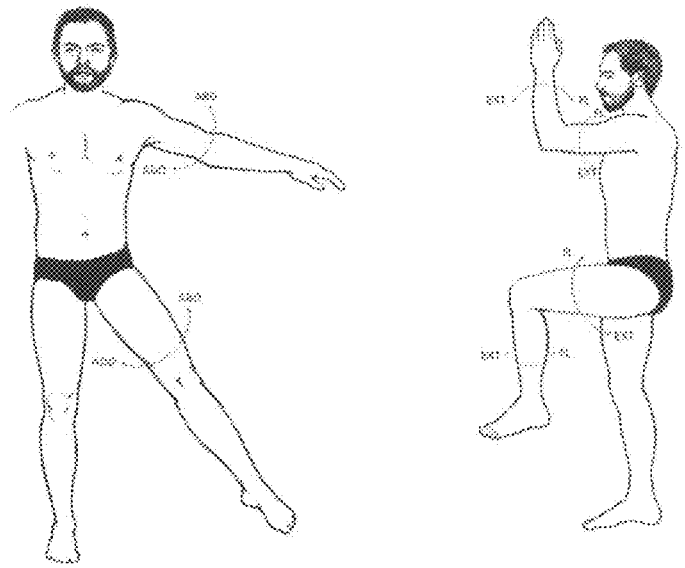
Abduction, adduction, flexion and extension
702
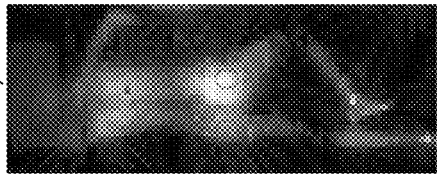
Areas to side of coccyx – when lying on back
703
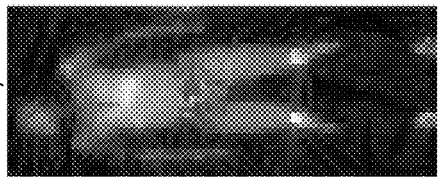
Areas to side of coccyx – when lying on front
704
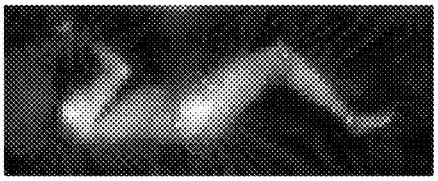
Areas to side of coccyx – when lying on side

BEDDING SYSTEM WITH SUPPORT SURFACE CONTROL

CROSS-REFERENCE TO RELATED APPLICATION(S)

This application claims priority under 35 U.S.C. §119(e) to U.S. Application No. 61/640,648, "Machine Vision for Support Surface Control," filed Apr. 30, 2012. The subject matter of the foregoing is incorporated herein by reference in its entirety.

BACKGROUND OF THE INVENTION

1. Field of the Invention

This invention relates generally to the monitoring and analysis of pressure data for the control of body support systems, including mattresses and other bedding systems.

2. Description of the Related Art

The performance of mattress and other bedding and body support systems depends in part on the amount of pressure and the distribution of pressure experienced by different parts of the body. Pressure mapping systems have been used to assess support surfaces and compare performance differences for different body types. Pressure mapping systems have also been used to design and test active bedding systems that are intended to minimize pressure across the body for medical and commercial applications. Pressure sensors have also been used to monitor bed pressure in order to reduce pressure where the bed contacts the body. However, simply reducing pressure on the body does not optimize the balance between comfort and support.

"Comfort" is commonly described as the way the surface of the mattress feels against the surface of your body. It can be a personal and subjective assessment of the mattress but there are mattress attributes that are known to impact this perception of comfort. The perception of comfort is primarily affected by the upholstery layers, particularly the cushioning and quilting. Mattress companies typically use words like "firm," "plush," and "pillow-top" to describe the comfort attributes of a bed, but this is simply a way of categorizing the softness or hardness of the surface layers. Other comfort-related attributes include features that minimize disturbance from your partner's movements, or that provide for differing levels of comfort on each side of the bed.

Comfort can be defined as a state of physical ease and freedom from pain or constraint. In the sleep industry, bedding systems are designed to provide maximum comfort by reducing pressure points on the body. For example, one manufacturer believes that pressures on the body must not exceed 0.5 pounds per square inch in order to maximize comfort. This pressure limit was chosen because it is generally accepted to be the point where blood circulation begins to be constricted and muscle tension begins to form. The end result of muscle tension and restricted blood flow is restless tossing and turning.

Bedding systems implement a wide variety of methods to reduce pressure points on the body. Latex or "memory foam," pocket coils, adjustable air beds, water beds, and pillow style "topper" layers are common technologies used to provide comfort by reducing pressure points. These systems work by increasing contact area and as a result the body pressure is distributed more evenly. However, there is a point where the redistribution of pressure via a softer bedding system can compromise the support of the mattress and this can result in back pain, feeling restricted and a less restful sleep.

"Support" commonly refers to the aspects of the bed that push back in order to hold your spine in position while you sleep. Unlike with comfort, which is largely a matter of personal preference, everyone requires some support from their mattress. Improper or inadequate support can result in tension or back pain, as your muscles try to compensate to keep your spine in alignment, and frequently causes pain and/or stiffness when you wake up. Though mattress companies use words like "firm" or "extra firm" to explain the support provided by a bed, what they are really describing is the extent to which the inner core of the mattress is "springy" or "stiff." The sleep surface should hold the spine as closely as possible to its natural alignment regardless if you are a back or side sleeper. However, the support requirements can be very different between side and back sleeping.

Bedding systems implement a wide variety of methods to provide support. Latex foam mattresses typically have a firmer inner layer to provide better support over the softer outer layer. In an innerspring mattress, support is driven primarily by the spring coils, both in their quantity and their construction. Pocket coils are know for providing exceptional support as they can provide varying and appropriate levels of support to different areas of the body, for example, head, chest, hips, or ankles. Air beds and water beds use fluid as the inner support layer and are fully customizable in terms of the firmness or support provided by the adjustable core.

Bedding system manufacturers typically offer a wide array of systems that provide varying degrees of firmness at both the outer layers (comfort layer) and the inner layers (support layer). This allows a customer to find a match for their body type and personal preferences.

However, support and comfort needs are known to change based on a person's body position or state of sleep. When buying a mattress it is common to be asked if you are a side sleeper or a back sleeper because the support requirements are usually very different between these positions. However, it is unnatural to spend all of your time sleeping in one position. Therefore, purchasing or configuring your bed to favour one position over another is a compromise at best.

Bedding systems that attempt to actively monitor pressure and make continuous adjustments typically rely on the process of trying to minimize pressure on all points of the body. However, focusing on minimizing pressure can lead to a bed surface that is too soft and provides inadequate support to ensure a restful and pain free sleep.

Therefore, there is a need for a bedding system that adjusts the support and comfort of the system in response to changing conditions.

BRIEF DESCRIPTION OF THE DRAWINGS

The invention has other advantages and features which will be more readily apparent from the following detailed description of the invention and the appended claims, when taken in conjunction with the accompanying drawings, in which:

FIG. 5 shows examples of adjustable mattress systems.

FIG. 6 is a table of standard mattress sizes.

FIG. 8 is an example of a machine learning user interface.

FIG. 10 is a table of sleep states with corresponding mattress adjustments.

FIG. 11*a* is an example of an adjustable pillow.

FIG. 33 shows example intermediate outputs for steps in the method for calculating the medial axis of the binary foreground image.

FIG. 34 shows example intermediate outputs for steps in the method for simplifying the medial axis into straight line segments.

FIG. 35 shows example intermediate outputs for steps in the method for joining collinear nearby straight line segments.

FIG. 36 shows example intermediate outputs for steps in the method for associating joined straight line segments with all possible compatible body segments in an association graph.

FIG. 37 shows terminology for movement of body segments, and examination of areas to the side of the coccyx, both relating to scoring pose candidates.

DETAILED DESCRIPTION OF THE PREFERRED EMBODIMENTS

Figure 1:
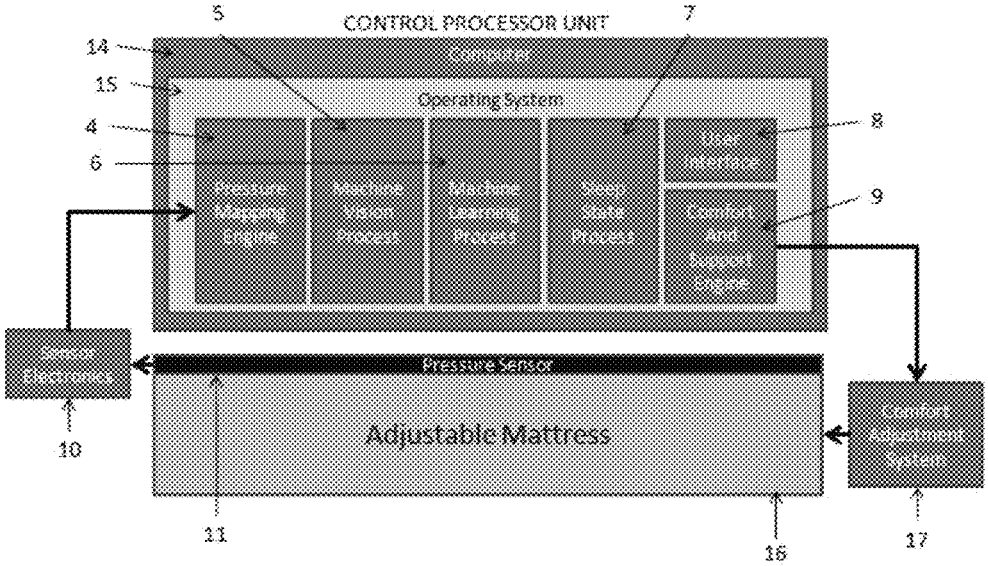
FIG. 1 is a diagram of a bedding system for comfort and support control.

Bedding system designers often use the attributes of hammocking, envelopment, and immersion to measure the support and comfort characteristics of a mattress. Hammocking refers to either lateral or longitudinal sag that is indicative of a system that is providing inadequate support and may be uncomfortable in the long term. Hammocking may be detected by elevated pressures around the edges of the body. Envelopment refers to how even the pressure is across the entire contact area. An extra firm mattress can have pressure peaks around the head, shoulders, hips, and heels. This uneven distribution of pressure is indicative of poor envelopment by the supporting surface and may result in both discomfort and poor spinal alignment. Immersion refers to the depth that the body sinks into the mattress or the difference between the unloaded surface height and the maximum penetration depth (indentation caused by the body). Immersion should be appropriate for a person's weight and body type in order to optimize envelopment while ensuring spinal alignment.

A pressure sensor measures the surface pressure distribution of a body supported by a surface, for example a person lying on a mattress or other bedding system. The pressure measurement data is analyzed to quantify comfort and support attributes such as hammocking, envelopment, and immersion. Contact area and peak pressure are examples of measurable parameters acquired from a pressure sensor that relate to a bedding system's comfort and support attributes.

In one implementation, the bedding system analyses pressure and contact area data in the current sleeping position and adjusts the firmness of the bedding system until the contact area and pressure distribution is optimized for comfort and support. Further adjustments can be done manually to accommodate personal preference. Alternately, the automatically determined firmness can be increased or decreased based on the person's sleep state.

In another aspect, a two person bedding system analyses pressure and contact area data independently for each person and adjusts firmness on each side of the bed to optimize comfort and support attributes for the size, weight, and sleeping position of each person. Further individual adjustments can be done manually to accommodate personal preference or the automatically determined firmness can be increased or decreased based on the person's sleep state.

In another aspect, the bedding system uses pressure information to locate body zones and determine sleep states in order to adjust localized attributes of support and comfort. These support and comfort attributes can include, for example, support layer firmness, comfort layer firmness, bed temperature, ambient noise and other environmental parameters. Support and comfort attributes can be localized to zones or areas of the body, for example, a head zone, a cocyx and ischial zone, and a heel zone.

In another aspect, a person's support and comfort requirements can change depending on a person's physiological or sleep state. For example, when a person first enters the bed, the bedding system may alter its support and comfort attributes in order to induce sleep. These same attributes may not provide the adequate environment to ensure a restful sleep throughout the night. Similarly, if a person becomes restless in the middle of the night, the bedding system can invoke a sleep inducing comfort to restore restful slumber. In another example, a bed's support and comfort attributes can be adjusted to inhibit sleep when it is time to get up in the morning.

FIG. 1 is a diagram of a bedding system with comfort and support control. The system shown in FIG. 1 includes the following major components: the bed sensor (11), the sensor electronics unit (10), the control processor unit (14), the comfort adjustment system (17), and the adjustable mattress or other adjustable bedding system (16). The control processor unit typically is a computer that includes software subcomponents including the operating system (15), the pressure mapping engine (4), the machine vision process (5), the machine learning process (6), the sleep state process (7), the comfort and support engine (9), and the user interface (8).

Bed Sensor.

A bed pressure sensor (11) can come in various sizes to suit a wide range of standardized mattress sizes. The bedding system can support the acquisition of pressure data for a single person or the simultaneous acquisition of data for two people. For example, single person bed sensors typically have sensing areas ranging from 30"×74" to 54"×84", or preferably 32.5"×80", while two person bed sensors have sensing areas ranging from 60"×74" to 72"×84", or preferably 65"×80". Alternatively, two single person sensors can be used to acquire pressure data on a two person bedding system. Alternatively, smaller sensing areas can capture only important pressure point areas such as the body core, including hips, shoulders and lower back.

Each pressure sensor (11) contains an array of individual pressure sensing elements. Mattress sensor resolution is typically 0.5" to 2" pitch, or preferably 1.25" pitch. A sensel is an individual sensor within a sensor array. Single person bed sensor arrays are typically 16 sensels×40 sensels to 64 sensels×160 sensels, or preferably 26 sensels×64 sensels. Two person bed sensor arrays are typically 32 sensels×40 sensels to 128 sensels×160 sensels, or preferably 52 sensels×64 sensels. The number of sensels required is dependant on the sensing area and the resolution of the sensor.

Bed pressure sensors (11) preferably are thin and flexible sensors that are designed to conform to the shape of the body of the person lying on the bed. They are typically covered with a light fabric, for example nylon taffeta, and may incorporate buckles, straps, or other methods of attaching the sensor to the adjustable mattress (16). Preferrably, the sensor is mounted underneath a surface or quilt layer of the mattress.

Figure 2:
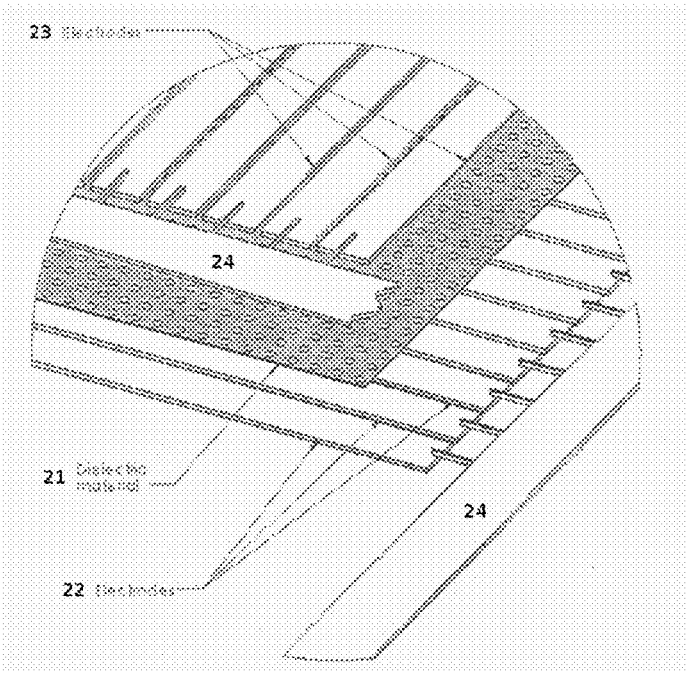
FIG. 2 is an exploded view of a capacitive pressure sensor.

Examples of bed pressure sensors include resistive pressure sensors, fibre-optic pressure sensors, or preferably capacitive pressure sensors. FIG. 2 illustrates the construction of an example capacitive pressure sensor. The sensor includes column electrodes (23) onto which a sinusoidal electrical signal is injected and row electrodes (22) where an attenuated sinusoidal signal is detected. The row and column electrodes are constructed of strips of electrically conductive material such as copper strips, aluminum strips, tin strips, or preferably conductive fabric or flexible circuit. The row and column electrodes are separated by a compressible dielectric material (21) such that the dielectric compresses according to the pressure applied to the surface of the sensor. An electrical signal is injected on a column electrode and is then attenuated as it passes through the dielectric material to the row electrode where the attenuated signal may be detected. The attenuation of the signal depends on the amount of mechanical dielectric compression resulting from the applied pressure. The detected signal can be measured by the sensor electronics and converted to a pressure value using a calibration process. The row and column electrodes are connected to the sensor electronics using a ribbon cable (24) or other electrically conductive wiring harness, for example, discrete wires, conductive fabric, printed circuit board, or preferably, a flexible circuit.

Sensor Electronics Unit.

Figure 3:
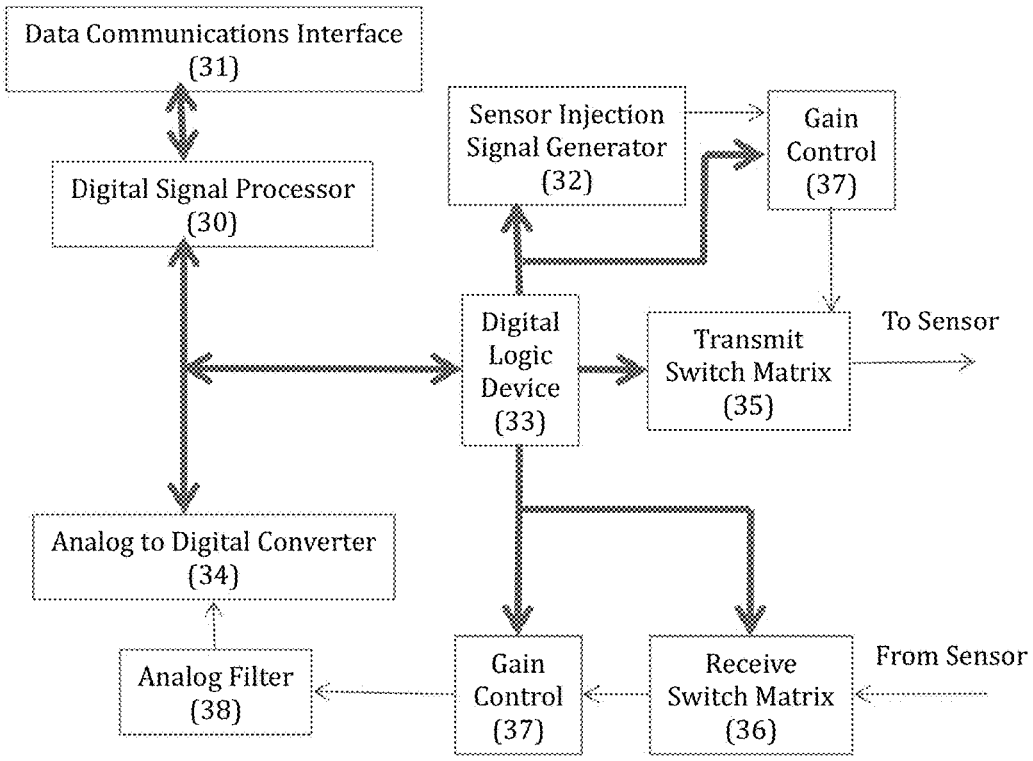
FIG. 3 is a block diagram of a sensor electronics unit.

An example sensor electronics unit shown in FIG. 3 includes a Digital Signal Processor (DSP) (30), injection signal generation and control (32), (37), (35), signal detection and control (36), (37), (38), (34), a digital logic device (33), and a data communications interface (31).

The DSP (30) executes firmware that is designed to receive control messages from application software running on a personal computer or embedded computer via the data communications interface (31). The control messages may include measurement requests that contain coordinates for an individual sensing element (sensel) within the pressure sensor array. The DSP (30) selects a column for the injection signal and a row for signal detection. The detected signal is then converted from analog to digital (34) for measurement processing by the DSP (30). The measurement is then passed back to the application software via the data communications interface (31).

The DSP (30) may be a standalone device or include external memory such as Random Access Memory (RAM), Read Only Memory (ROM), or any other commonly used memory device. Memory devices can be accessed either serially or via parallel data bus.

The sensor injection signal generation block (32) is an electronic device or circuit used to create a sinusoidal injection signal at a selectable frequency. The injection signal can be in the range of 1 kHz to 5 MHz, or preferably 1 kHz to 250 kHz.

The gain control block (37) is an electronic device or circuit used to adjust the amplitude of the injection signal. The gain setting is controlled by the DSP (30) via the digital logic device (33). The amplified injection signal is connected to the transmit switch matrix (35). The DSP (30) configures the digital logic device (33) to enable the appropriate switch in the switch matrix in order to select a sensor column for transmitting the injection signal.

The injection signal passes through the pressure sensor and is detected on a row selected using the receive switch matrix (36). The sensor row is selected by the DSP (30) via the digital logic device (33) and the selected signal is connected to the gain control block (37) for amplification.

An analog filter (38) removes signal noise before the analog to digital converter (ADC) (34). The analog filter is an electronic device or circuit that acts as a band pass or low pass filter and only passes frequencies near the injection signal frequency. For example, if the injection signal has a frequency of 250 kHz the filter only passes frequencies in the range of 200 kHz to 350 kHz and thereby rejects other interfering signals that are not within the pass band. The analog filter can be designed to accommodate pass bands of variable frequency spreads where tighter frequency spreads more effectively filter interfering signals.

The ADC (34) is periodically sampled by the DSP (30) in order to acquire sufficient samples for performing a measurement calculation. For example, 12, 24, 48, 96, or 192 samples can be acquired before performing a measurement calculation on the samples. The DSP (30) can also execute firmware to perform additional digital filtering in order to further reduce the frequency spread of the pass band and more effectively filter interfering signals. Digital filtering requires more samples from the ADC (34), for example in the range of 50 to 2500 samples, or preferably 512 samples.

The data communications interface (31) passes data between the DSP (30) and the application software running on the Control Processor Unit, see FIG. 1. The interface includes electronic devices or circuitry to perform wired or wireless communication. Examples of wired communication include RS232 serial, Universal Serial Bus (USB), Ethernet, fibre-optic, or any other serial or parallel data communication technology. Examples of wireless communication include, Zigbee, Bluetooth, WiFi, Wireless USB, or any other wireless data communication technology.

The digital logic device (33) includes electronic devices or circuitry, for example complex programmable logic devices (CPLD), field programmable gate arrays (FPGA), application specific integrated circuits (ASIC), or discrete logic devices. Alternatively, the DSP (30) has General Purpose Input Output (GPIO) pins that may be used in place of the digital logic device to control selectable electronic devices.

Comfort Adjustment System.

Figure 4:
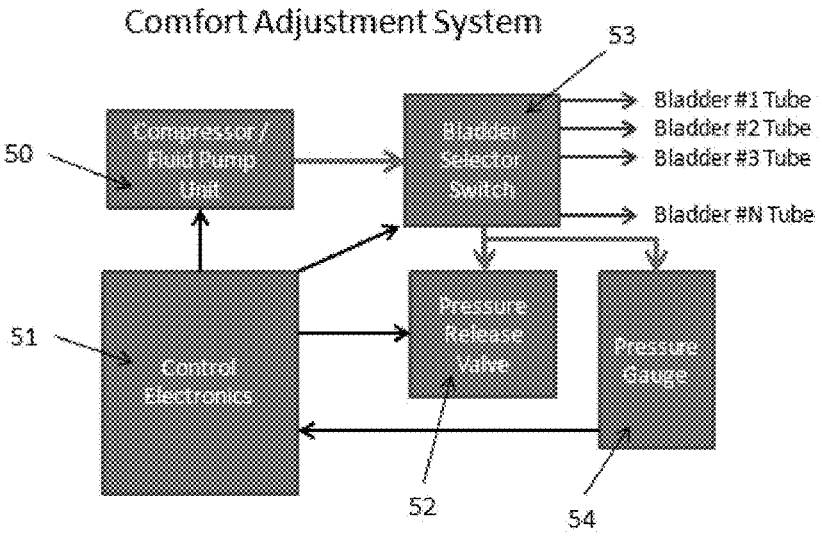
FIG. 4 is a block diagram of a comfort and support adjustment system.

An example comfort adjustment system shown in FIG. 4 includes control electronics (51), a compressor or fluid pump unit (50), a bladder selector switch (53), a pressure relief valve (52), and a pressure gauge (54).

The control electronics (51) is a multi-channel digital-to-analog converter (DAC) and analog to digital converter (ADC) device that is used to control the inflation and deflation of the fluid bladders in the adjustable mattress. A serial communication channel between the control electronics (51) and the Control Processor Unit (14) is used to allow the CPU to monitor and control the inflation of the air bladders.

The compressor or fluid pump unit (50) is used to provide fluid to pressurize the bladders in the adjustable mattress. For example, a pump can be used to inflate fluid bladders in the adjustable mattress. The pump is activated whenever the pressure in a bladder is increased. Alternatively, a compressor unit can be used to store fluid at a higher pressure and this fluid is used to inflate the bladders. The compressor has the advantage of activating the pump less often and therefore the system will be quieter. For example, the pump can run during non sleeping hours to fill the compressor. The bedding system is then operated from the compressor throughout the night. The activation of the pump or compressor is controlled by the Control Processor Unit (14) via the control electronics (51).

The bladder selector switch (53) is used to select a specific bladder in the adjustable mattress for inflation. The bladder selector switch is not required if the bedding system only has a single bladder. The bladder selector switch is capable of injecting fluid via individual tubes into 1 to a maximum of 1664 fluid bladders, or preferably 5 to 350 bladders based on 3" diameter bladders arranged in an array over a single or two person bedding system. Bladder selection is controlled by the Control Processor Unit (14) via the control electronics (51).

The pressure release valve (52) is used to deflate bladders in the adjustable mattress. The Control Processor Unit (CPU) instructs the electronics unit (51) to first select the desired bladder using the bladder selector switch (53) and then activates the pressure release valve to decrease the pressure in the selected bladder. The electronics unit simultaneously disables the compressor or fluid pump unit (50).

The pressure gauge (54) is used to measure the pressure in the adjustable mattress bladders. The Control Processor Unit (14) periodically samples each bladder via the electronics unit (51) in order to monitor inflation. For example, the Control Processor Unit (CPU) adjusts the inflation in a particular fluid bladder until the desired pressure measurement is obtained for the bladder being adjusted. The Control Processor Unit (14) then samples the pressure gauge for that bladder and stores this information for future reference.

Adjustable Mattress.

An example adjustable mattress shown in FIG. 5 includes a surface layer (40), a comfort layer (41), a support layer (42), and a base layer (43). The surface layer (40) is simply a cover material, quilt layer, or thin comfort layer consisting of down or synthetic "pillow top" pockets or a soft latex foam. The surface layer (40) is 1" thick, or less. The comfort layer (41) consists of common bedding materials such as latex, memory foam, polyurethane foam, natural and/or artificial fibers, microcoils, or buckling column gel. The comfort layer may also include an adjustable fluid bladder system underneath the common comfort layer bedding materials, such that the firmness of the comfort layer can be adjusted. The comfort layer can range between 1" and 6" thick, or preferably 3" thick. The support layer (42) is the core of the mattress and consists of common bedding materials such as latex foam, polyurethane foam, innersprings or pocket coils, or preferably an adjustable fluid bladder system. The support layer (42) can range between 3" and 24" thick, or preferably 4" to 6" thick. The base layer (43) consists of latex or polyurethane foam. It serves as a protective layer for the core support layer and ranges between 1" to 2" thick. The firmness of the adjustable fluid bladder layer is determined by the Comfort Adjustment System in FIG. 4.

The adjustable fluid bladder layer can be a single bladder (47), multiple longitudinal bladders (44), multiple lateral bladders (45), or an array of cylindrical bladders or cells (46). The cylindrical bladders may also be oval or rectangular in shape to reduce the number of cells. The bladder systems vary in size to fit the industry standard bed sizes as shown in FIG. 6. Two person bed sizes, king size for example, will consist of two equally sized single bladders (47), two equally sized columns of lateral bladders (45), or wider versions of the longitudinal (44) or cylindrical array (46) bladders. The longitudinal fluid bladders (44) range in size from 1" to 12" wide with a length that is appropriate for the mattress size. The lateral fluid bladders (45) range in size from 1" to 12" wide with a length that is appropriate for the matress size. The cylindrical bladders (46) range in size from 1" diameter to 6" diameter.

Application Software.

In this example, the bedding system application software runs on a standard embedded computer device (14), for example, an Intel processor based module equipped with Universal Serial Bus ports and WiFi and Bluetooth wireless capability.

The application software runs with a standard computer or embedded operating system (OS) (15) such as Linux, embedded Linux, NetBSD, WindowsCE, Windows 7 or 8 embedded, Mac OS, iOS, Android, QNX, or preferably, Windows8.

Figure 7:
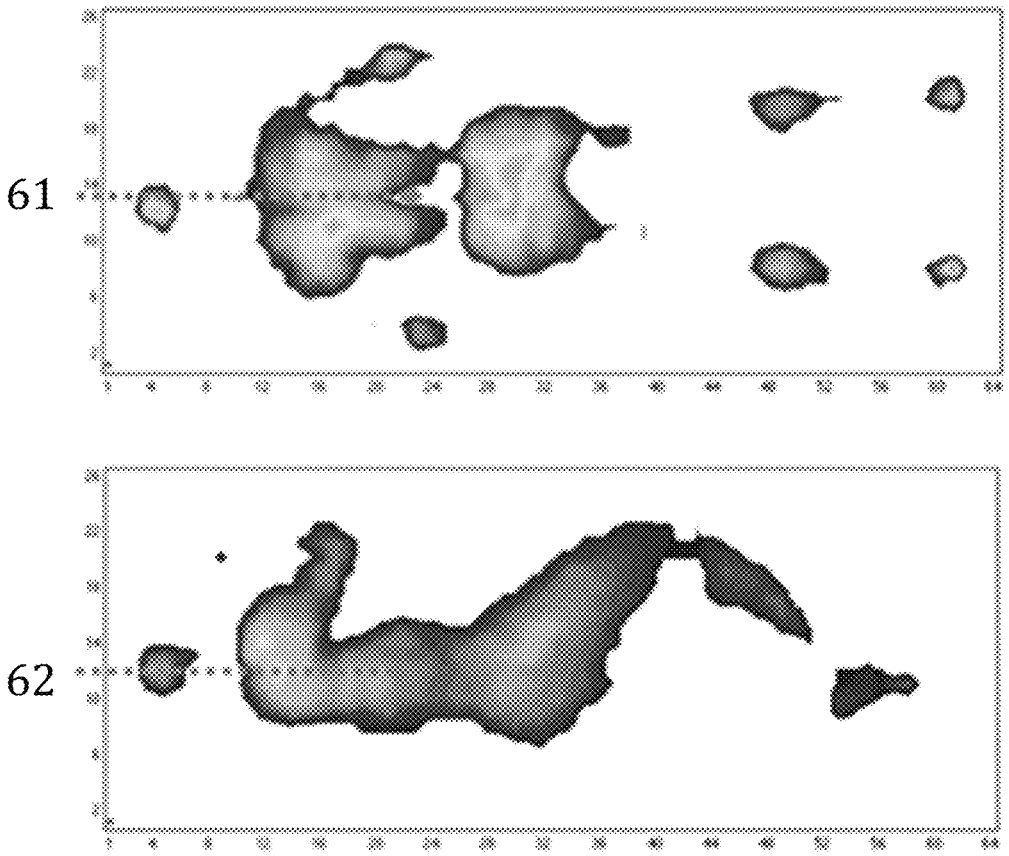
FIG. 7 is a representative image of pressure sensor data.

The pressure mapping engine software performs basic functionality such as data messaging with the sensor electronics (10), conversion of measurements from the sensor electronics (10) to calibrated pressure values, and organization of data into an array of measurements representative of the sensor array. The pressure mapping engine can also operate in a non-calibrated mode where raw pressure sensor measurements are compared and processed relative to other raw pressure sensor measurements and absolute pressure values are not calculated. An example of an array of pressure measurements shown in FIG. 7, includes a two-dimensional pressure image of a person lying on their back (61) and a two-dimensional pressure image of a person lying on their side (62). This is a graphical representation of the measurement information that is generated and stored by the pressure mapping engine. Areas of low pressure measurements are shown in darker shades or colours.

The pressure mapping engine software calculates a number of parameters that are derived from the pressure image.

For example, contact area can be calculated for the entire pressure sensing area. Contact area is based on the number of sensels with measured pressure above a minimum threshold.

In another example, average peak pressure can be calculated over the entire pressure sensing area. In one approach, average peak pressure is calculated by isolating a group of sensels with the highest measured pressures (the peak pressures), then averaging those pressure values to obtain the result. A sensel is an individual sensing element within the sensor array. For example, using a bed sensor with 1664 sensels in the sensor area, the 16 sensels with the highest pressure measurements could be averaged to determine the average peak pressure. The number of sensels averaged could be 25% to 0.5%, or preferably 1%, of the total number of sensels in the array. The number of sensels averaged could also be 25% to 0.5%, or preferably 1%, of the total number of sensels in the array that are above a pressure threshold, for example, 10 mmHg. The average peak pressure algorithm may also reject peak pressures to reduce the impact of creases in the sensor, objects in the customer's pockets, or hard edges in the customer's clothing. For example, the one to ten, or preferably three, highest pressure measurements can be excluded from the average peak pressure calculation.

Other pressure related parameters can also be calculated from the sensor data. For example, a load calculation could be used to estimate the person's weight. The person's height can be estimated by adding the number of sensels above a minimum pressure from the person's head to their toes, when they are lying on their back. Shear force can also be estimated based on the pressure gradient between sensels. In another example, pressure data can be used to analyze the distribution of pressure over the entire sensing area.

The pressure data and related metrics are then further processed by the machine vision (5), machine learning (6), and sleep state (7), and comfort and support (9) software applications.

The machine vision process (5) analyzes pressure data to identify body types and to identify body position. For example, when a person first lies on a two person mattress the machine vision process analyzes the two-dimensional pressure image of the sleeper and derives a physical profile. The physical profile is matched to the two physical profiles stored during the set up process of the bedding system. The machine vision process determines the identity of the person entering the bed and passes this information to the comfort and support engine (9). The bedding system can then be configured appropriately for that person.

A "physical profile" is at least one physical attribute of individuals which can be derived from the pressure sensor dataset acquired from a reference mattress. The physical profile may include attributes such as measurements of certain body features, for example, height, weight, shoulder-width, hip-width or waist-width; or ratios of these measurements, for example, shoulder to hip ratio, shoulder to waist ratio, or waist to hip ratio; body type, for example endomorph, ectomorph, endomorph; or Body Mass Index (BMI).

In another example, a peak pressure curve is created along the length of a person lying on their back or side. Mass distribution requires calculation of a mass based on applied pressure over a given unit area. For example, a mass can be calculated for each individual sensel in the sensing array by multiplying the measured pressure by the area of the sensel. Mass can also be calculated for larger areas by averaging pressure measurements over a group of sensels, for example 2×2 or 4×4 sensels. A body mass curve can also be created along the length of a person lying on their back or side. A peak pressure curve and/or a body mass curve can also be used for matching a body profile.

The machine vision process (5) continuously monitors and processes the pressure data to determine a person's body position. For example, position classifications can include "on back," "left side," or "right side." The body position is passed to the comfort and support engine (9) and the bedding system is configured appropriately for the person's body position.

Details of an example machine vision process are provided in U.S. Application No. 61/640,648, "Machine Vision for Support Surface Control," filed Apr. 30, 2012, which is incorporated by reference herein.

The machine learning process (6) uses the pressure data to detect changes in pressure that indicate movement or restlessness. For example, if the pressure sensels above a minimum pressure threshold show little variation over a period of time, then the person can be considered as motionless. A variation threshold of 10% to 100%, or preferably 25% of the measured pressure can be used to determine if there is movement on a particular sensel or group of sensels. The machine learning process tracks periods of stillness and movement to create a person's sleep profile for the night. Major position changes are detected by the machine vision process (5) and these can also be tracked to determine if a person has been tossing and turning throughout the night.

When the machine learning process (6) detects a restless state then this information is passed to the comfort and support engine (9) where the bedding system comfort and support attributes are adjusted to help induce a deeper, more restful, sleep.

The user interface (8) can also solicit feedback on a person's sleep after they have awakened in the morning. An example of a sleep feedback interface is provided in FIG. 8 where the person ranks comfort, back pain, quality of sleep, stiffness, and feeling of tiredness on a scale of 1 to 5. The machine learning process (6) uses this feedback information to assess the success of support and comfort attribute adjustments that were made throughout the night. Support and comfort attributes that show a statistical improvement in sleep quality will be implemented more frequently to improve overall sleep quality.

The sleep state process (7) uses pressure data and data from the machine vision process (5) and the machine learning process (6) to assess the state of a person's sleep. For example, bed entry can be detected when the pressure data changes from no pressure to a pressure indicating that there is a person on the bed. The "bed empty" state is detected when a threshold number of sensels are below a threshold pressure value. For example, if 100% to 90%, or preferably 98% of sensels measure pressure below 1 mmHg to 20 mmHg, or preferably 5 mmHg, then the sleep state is "bed empty." A transition from the "bed empty" state to "bed entry" state indicates that a person has gotten into bed.

Figure 9:
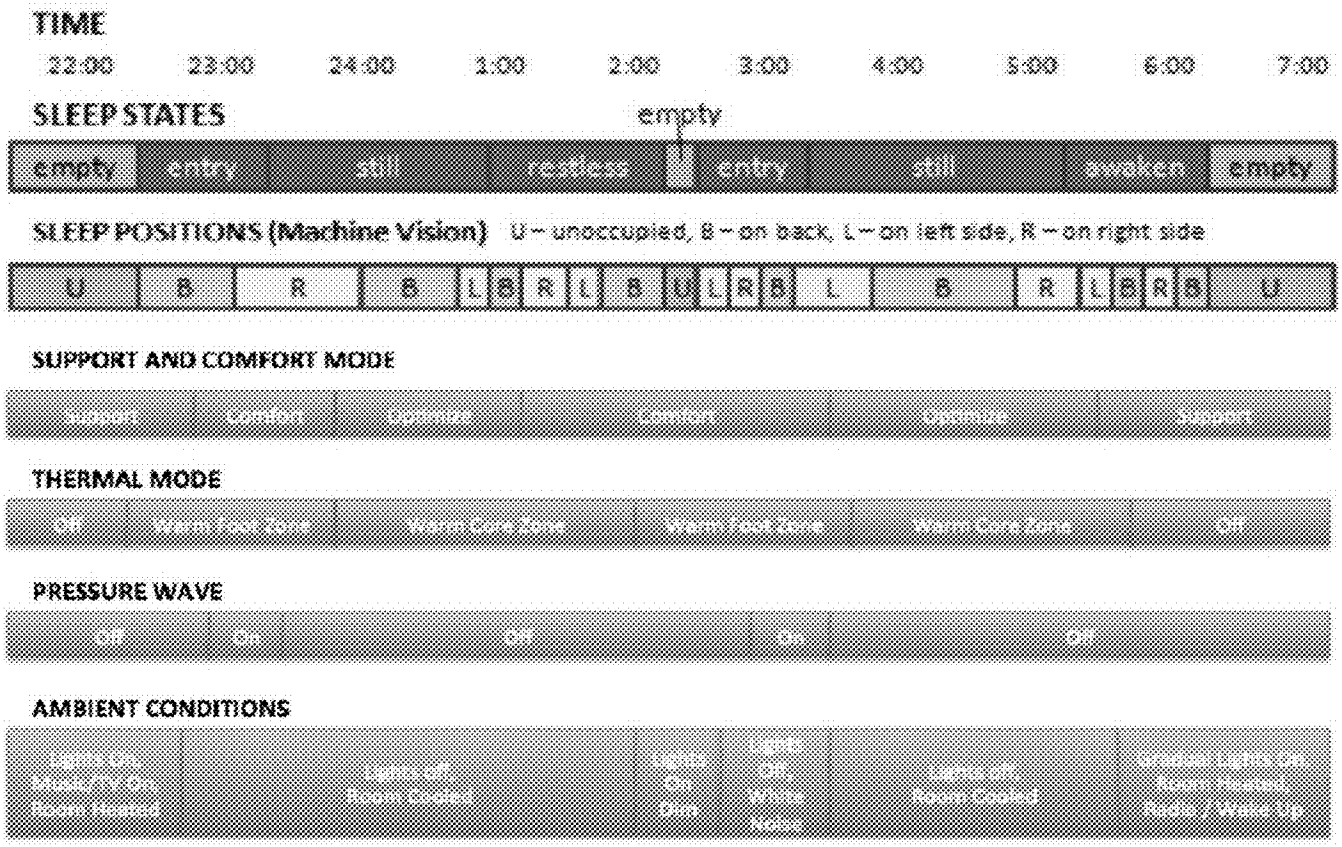
FIG. 9 is an example of a sleep state sequence.

An example of a sleep state sequence in FIG. 9 shows a person transitioning between "bed entry," "still", and "restless" states with corresponding body positions determined by the machine vision process (5). The sleep state information is passed to the comfort and support engine (9) that initiates adjustments to the support and comfort attributes of the adjustable mattress. For example, in the "bed entry" and "restless" states, the amount of support can be reduced and comfort increased to induce sleep. Support can be compromised in favor of comfort until a restful sleep is restored. In the "still" state, support is increased even if it results in a reduction in comfort. This is to ensure the best spinal alignment during deep sleep. In the "awaken" state, the support and comfort attributes can be adjusted such that sleep is inhibited, for example, the adjustable mattress can be made extra firm.

The sleep state process (7) can utilize pressure data or other sensors to detect the accepted standard 5 stages of sleep: stage 1, transition stage between sleeping and waking where the brain produces high amplitude theta waves; stage 2, the body prepares to enter deeper sleep where brain waves become slower and bursts of rapid, rhythmic brain wave activity known as sleep spindles occur, body temperature starts to decrease and heart rate begins to slow; stage 3, transitional state between light and deep sleep, slow brain waves known as delta waves begin to occur; stage 4, deep sleep where delta waves occur; stage 5, Rapid Eye Movement (REM) sleep, characterized by eye movement, increased respiration and increased brain activity. Micro changes in pressure can be analyzed to detect changes in respiration or a brain wave sensing headband could be worn to detect the beta, alpha, theta and delta waves associated with the 5 stages of sleep.

Sleep state or sleep stage information can be passed to the machine learning process (6) to compare the night's sleep to previous or average patterns recorded. This information can be used to assess the performance of the support and comfort attribute adjustments implemented through the night.

The comfort and support engine (9) uses inputs from the pressure mapping engine (4), the machine vision process (5), the machine learning process (6), and the sleep state process (7) to select or adjust support and comfort attributes of the adjustable mattress. The comfort and support engine calculates the desired settings for each of the bladders in the support and comfort layers of the adjustable mattress (16) and communicates with the comfort adjustment system (17) to implement these settings. The comfort and support engine (9) uses the inputs from the other software applications to automatically determine the most appropriate adjustable mattress settings. A manual process can also be used to derive or adjust the settings. An example in FIG. 10 lists sleep state related adjustments to the comfort and support layers of the adjustable mattress (16).

User Interface Device.

The Control Processor Unit can be manually controlled with a user interface device. The user interface device can be a built in touch panel computer or a simple handheld input device. The Control Processor Unit can also connect wirelessly to an external user interface device such as a laptop computer, tablet computer, or smart phone device. The pressure sensor (11) may also be used as an input device where settings are made using gestures. For example, tracing an "L" shape anywhere on the sensor will lower the firmness of the mattress by a predetermined amount.

Accessory Devices.

The Control Processor Unit can have additional input output control for monitoring and controlling accessory devices that affect comfort attributes. Accessory devices include temperature control devices, temperature sensors, white noise generators, audio sensors, biofeedback sensors, lighting controls, and light sensors. Communication and control of the accessory devices can be performed via the Universal Serial Bus (USB) port, Firewire port, or via Bluetooth or WiFi wireless connections.

The bedding system can include a thermal control device that regulates temperature on the mattress surface. The temperature can be elevated to increase comfort and induce sleep or it can be lowered slightly to promote sound sleeping. The temperature can be further lowered to promote awakening. The temperature can be controlled via a single or multiple "zoned" thermal pad using, for example, either electrical heating elements or flexible fluid thermal coils where fluid is heated or cooled by an external unit. An external thermal controller unit can provide heating and cooling of the fluid as well as control the circulation of the fluid through the bedding system. The thermal pads can be installed under the surface layer of the mattress, embedded in the comfort or support layer, or incorporated into a blanket or other bed covering.

The thermal control device can contain the electronics, pumps, and power supplies required to operate. External control from the comfort and support engine (9) is provided via USB or wireless communication interfaces. Alternatively, the Control Processor Unit can provide general purpose input and ouput signals to control switches and relays within the thermal control device.

The bedding system can provide a low air loss layer or overlay that provides microclimate control by reducing pressure across one or multiple zones and providing continuous air flow at the bed surface. The low rate airflow helps to control humidity and moisture. Moisture or temperature sensors may also be incorporated in the bedding system to determine when a person is getting too warm or perspiring too much. The rate of airflow can then be adjusted to provide maximum comfort over a wide range of environmental conditions.

The bedding system can include temperature sensors that can be used to monitor body temperature and detect changes in sleep state. The temperature sensors in conjunction with the temperature control device can regulate body temperature in response to changing environmental and physiological conditions throughout the night. Temperature sensors in the bedding system can track core body temperatures and the legs, arms, hands, and feet to determine a person's sleep state.

The bedding system can provide zone specific heating and cooling that will create sleep or wakefulness inducing conditions. Proximal skin warming (hands and feet) suppresses wakefulness and distal skin warming (torso and legs) enhances wakefulness. The machine vision process (5) in conjunction with the sleep state process (7) can locate the distal and proximal body zones and warm or cool these areas slightly to induce sleep or wakefulness. For example, when a person first enters the bedding system the thermal pads can be activated to slightly warm the hands and feet, or preferably feet only. During the "awaken" state the thermal pads around the body's core can be slightly warmed to increase wakefulness. The machine learning process (6) can monitor the success of the proximal and distal skin warming and make adjustments to duration and thermal gradient to optimize the settings for the most restful sleep.

The bedding system can control a white noise generator or other audio sources to create a more comfortable environment. Soft music can induce sleep and can be activated when a person first goes to bed or if the bedding system determines that the person is experiencing restlessness. White noise is known to improve sleep in noisy environments. For example, an audio sensor can detect a partner's snoring and activate white noise to lessen the disturbance caused by the snoring.

Biofeedback sensors can be used to help determine a person's sleep state. This can provide more accurate input to the sleep state process (7). A light sensor can also be used as input to the sleep state process. For example, if the sensor detects that a light is on in the room then the support and comfort attributes may not be adjusted until the light has been turned off. In another example, the sleep state process determines that the person is asleep but the light is still on. In this case the lighting control accessory is used to turn off the lights.

A person's location on the bed can be determined by the machine vision process (5) and an alert state can be initiated if the person is too close or overhanging the edge of the bed. The bedding system can then generate an audible alert to awaken the person. Alternatively, additional bladders can be located along the longitudinal length of the bed and these restraint bladders can be inflated to prevent a fall and gently force the person away from the edge of the bed.

The comfort and support engine (9) can control the adjustable mattress (16) via the comfort and adjustment system (17) to create a travelling wave of pressure across the adjustable mattress. The pressure wave can help induce sleep and reduce tossing and turning by creating a sensation of rocking or floating. For example, a sinusoidal wave of pressure can roll from one end of the adjustable mattress to the other. Various types of pressure waves can be sampled and selected via the user interface (8). For example, a person can select the amplitude of the wave, the period of the wave, the time between consecutive waves, the direction of the wave (lateral or longitudinal), the wave shape (sinusoidal, square, rectangular, triangular, adjustable rise and fall times for square, rectangular, or triangular waves), the wave pattern (pulsed, periodic, swept amplitude, random), the duration that the pressure wave will be activated, and the sleep states where the pressure wave will occur. The pressure wave can be activated when the machine learning process (6) detects a sleep state where additional comfort is desired.

Figure 11B:
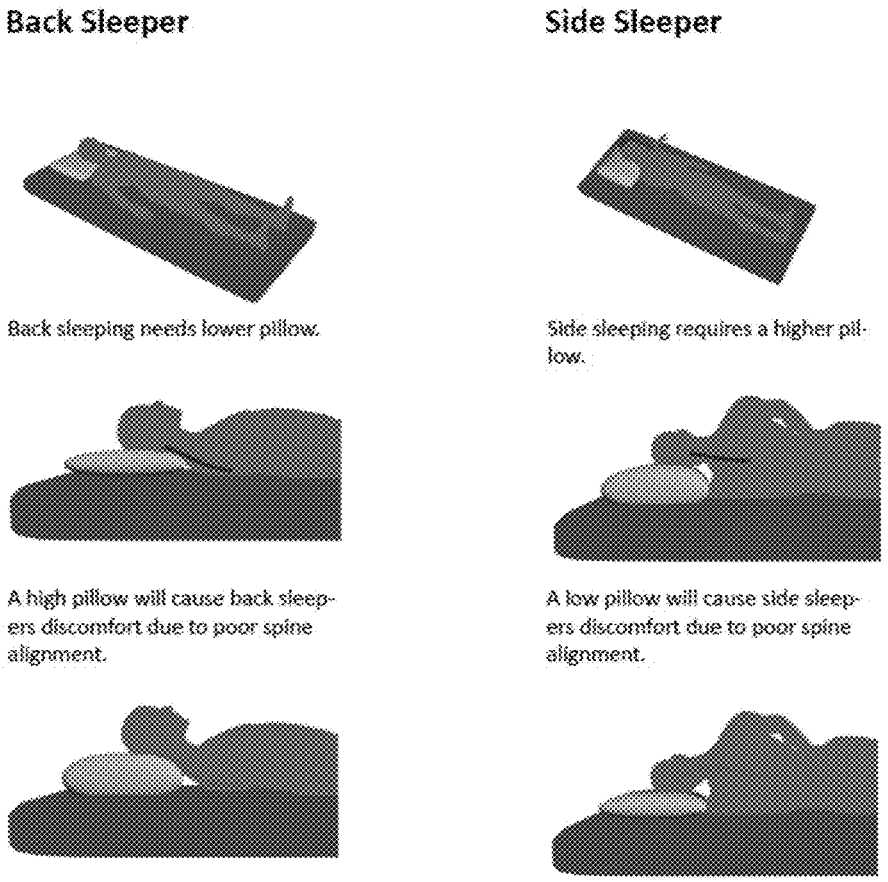
FIG. 11*b* illustrates spinal alignment for an adjustable pillow.

The bedding system may also control an adjustable pillow. The construction and operation of the adjustable pillow can be similar to that of the adjustable mattress. An example of an adjustable pillow shown in FIG. 11*a* contains an adjustable comfort layer, an optional thermal pad layer, and/or an adjustable support layer. Alternatively, the adjustable pillow can contain an adjustable support layer, a comfort layer, and a surface layer. A pressure sensor can be embedded in the surface layer and a sensor electronics unit can provide pressure measurement data to the Control Processor Unit. FIG. 11*b* illustrates how the support layer of the adjustable pillow can be adjusted to provide optimum spinal alignment based on the person's sleeping position. The machine vision process (6) communicates body position (on back, on side) to the comfort and support engine (9) and the comfort and support engine appropriately adjusts the pillow height to optimize spinal alignment. The adjustment of the pillow support layer can be optimized during configuration of the bedding system or it can be adjusted to a surface pressure that provides the best comfort and support based on contact area and peak pressure. Alternatively, a pressure sensor is not included in the pillow and the optimum support adjustment is determined during the bedding system configuration.

The adjustable pillow can also include a thermal pad and temperature sensors that are controlled to improve comfort. For example, as the pillow can be warmed or cooled according to a person's personal preferences. The desired pillow temperature can be sampled and selected via the user interface. A desired temperature can be selected and different temperatures can be selected based on the person's sleep state. For example, a person may select a warmer pillow when in the "bed entry" or "restless" state and then a cooler pillow when in the "still" or "deep sleep" state. The control of the thermal pad can be provided in the same manner as the mattress thermal pads.

An example of a sleep state sequence and the corresponding bedding system and accessory comfort and support modes in FIG. 9 indicates how the bedding system can respond to changing sleep states and sleeping positions. The adjustable mattress and adjustable pillow can be set according to the sleep state determined by the machine vision process (5). Support and comfort modes can be selected to favor comfort or support or to optimize the balance between the two attributes. The thermal pads can be adjusted to appropriate sleep inducing or sleep inhibiting modes. A pressure wave can also be temporarily activated to induce sleep when a person enters the bed or when restlessness is detected. Other ambient conditions such as lighting, audio, and room temperature can also be adjusted for the sleep state determined by the sleep state process (7).

Figure 12:
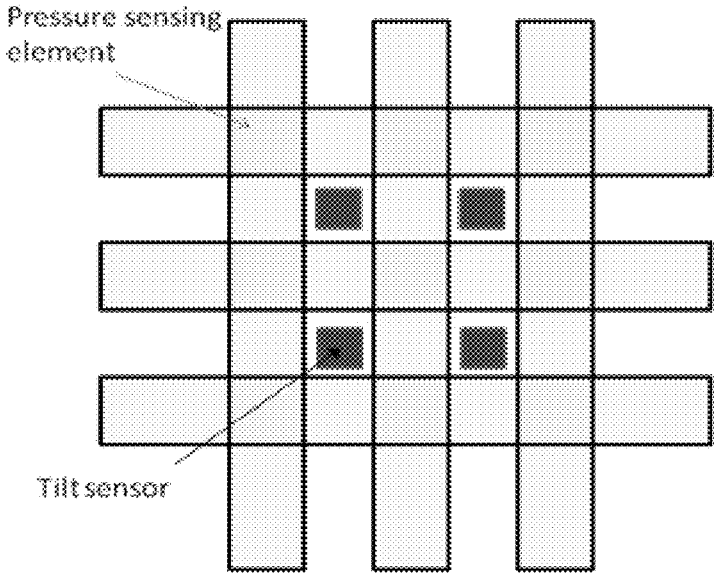
FIG. 12 is an example of a shape sensing array.

The bedding system can also incorporate shape sensing technology to ensure proper spinal alignment. An example of a shape sensor incorporated into the pressure sensor (11) in FIG. 12 includes additional tilt sensors inserted in between pressure sensing elements in the pressure sensor array. The number of tilt sensors incorporated in the sensor array is dependant of the size of the pressure sensing array. Tilt sensors can cover the entire sensing area or can be a more narrow array covering only the center line of the pressure sensor. For example, on a 26×64 pressure sensor, the tilt sensing array can be 1×64 to 10×64 in a center line configuration or 26×64 to cover the entire sensing area. In another example, the tilt sensing array only covers a body zone from the head to the hips in order to sense the shape of the neck and spine only. An example of a zone sized tilt sensing array can be 1 to 10 columns by 25 to 50 rows in a center line configuration. The tilt sensing array can be interleaved with the pressure sensing array by inserting tilt sensors in between the pressure sensing elements or by substituting tilt sensors in place of pressure sensing elements. Alternatively, the tilt sensing array can be an additional layer of the pressure sensor.

In another example, the tilt sensors can be incorporated into a form fitting garment with a column of tilt sensors running down the length of the spine. In another example, the tilt sensors can be incorporated into a pillow either as part of a pressure sensor layer or independently if the pillow has no integrated pressure sensor. The pillow tilt sensor array can be integrated into both sides of the pillow and can cover the entire surface of the pillow or a smaller area around the middle of the pillow. For example, a tilt sensor pillow array can be 1 to 10 columns by 10 to 25 rows with a separate array on both sides of the pillow.

Figure 13A:
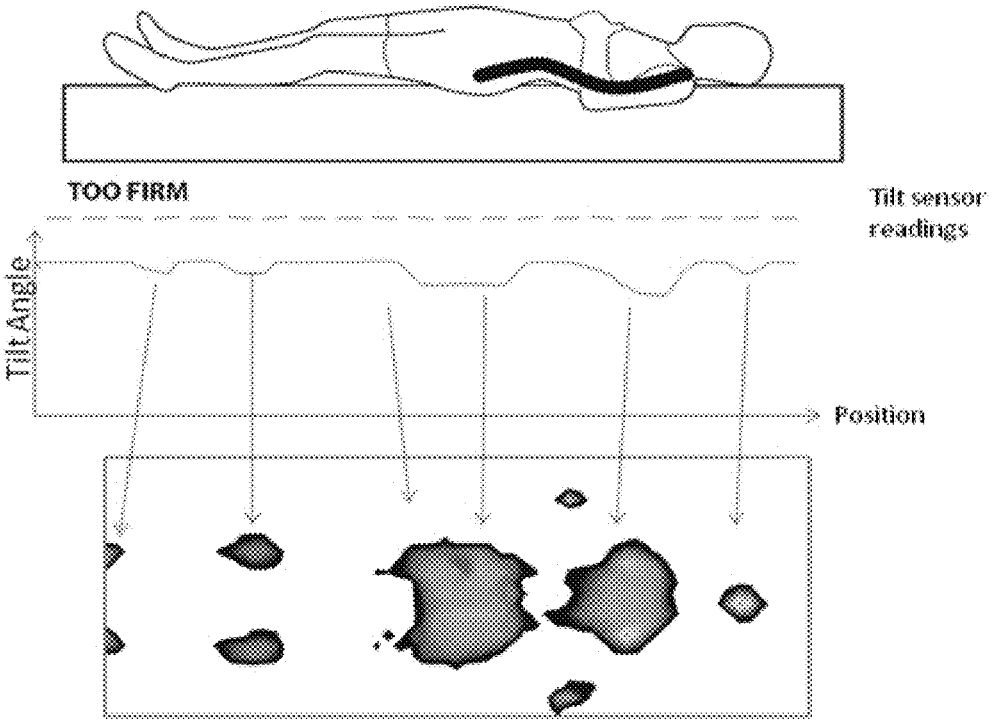
FIG. 13*a* illustrates tilt data related to spinal alignment for a back sleeper.
Figure 13B:
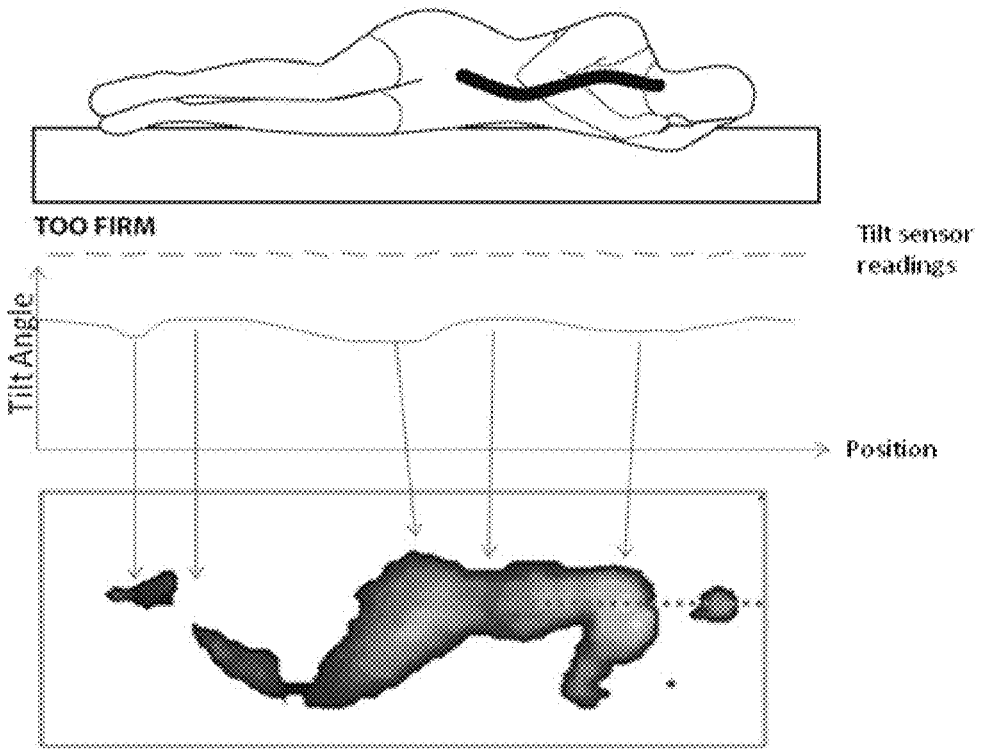
FIG. 13*b* illustrates tilt data related to spinal alignment for a side sleeper.

The shape sensor conforms to a person's body as it is enveloped by the mattress. FIG. 13*a* illustrates that the tilt sensor data can be used to construct a shape profile that can be used to optimize spinal alignment for a person sleeping on their back. FIG. 13*b* illustrates that the tilt sensor data can be used to construct a shape profile that can be used to optimize spinal alignment for a person sleeping on their side. A person's spinal alignment can be optimized through a manual or automatic process where the adjustable mattress firmness is swept from firm to soft and tilt profile data is analyzed by the machine vision process (5). Regions of the body that are immersed in the mattress but still flat will have tilt angles approaching zero. Body areas with deeper immersion in the mattress will have edges that have significant tilt angles. Tilt data can be interpreted in conjunction with pressure data. Regions of high pressure can have significant immersion relative to lower pressure areas. Pressure and tilt information can be correlated to create a 3 dimensional representation of the adjustable mattress surface.

Bedding System Configuration.

Figure 14:
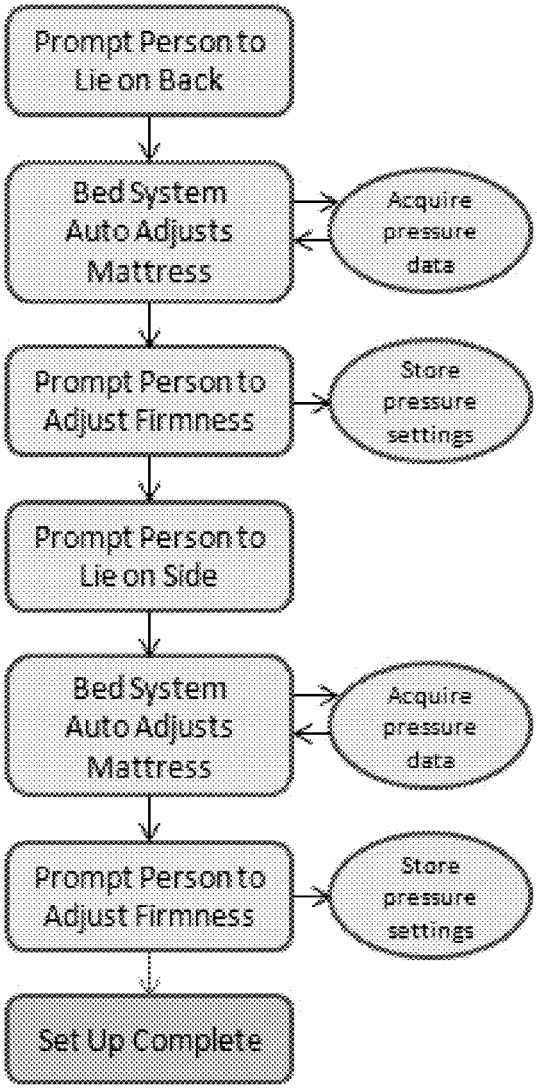
FIG. 14 is a flow diagram configuration process for a bedding system.

The user interface (8) can be used to set up the adjustable mattress either as an initial configuration when the bedding system is first purchased or as an 'on demand' process to recalibrate the mattress to changing conditions or preferences. An example of a bedding system configuration process in FIG. 14 prompts the person to first lie on their back. Pressure data is acquired from the sensor and the comfort and support engine attempts to optimize the support and comfort attributes based on the pressure data acquired as the adjustments are being made. The person is then prompted to make manual adjustments to allow them to adjust the mattress to their personal preferences. The person then hits done to store their preferred settings for back sleeping. The person is then prompted to turn on their side and the same process is repeated.

Once the initial bedding system set up is complete, the comfort and support engine (9) can automatically implement the back or side settings based on the sleeping position detected by the machine vision process (5). Further automatic adjustments of the support and comfort attributes can be performed in response to the machine learning process (6) or the sleep state process (7).

In another example, the bedding system configuration is followed with the assistance of a sleep specialist, either at home or in a retail setting, that assists in making the manual adjustments to ensure proper spinal alignment. In another example, the user manual can provide instructions on how two people can assist each other in verifying spinal alignment with configuring the bedding system.

In another example, the bedding system configuration includes the set up of accessory devices. For example, a person can select various accessory responses for each of the sleep states. A person can select that the zone around their feet is heated when they first enter the bed. A person can select that soft music or white noise is played when a restless sleep state is detected.

Automated Adjustment of Support and Comfort Attributes.

Figure 15:
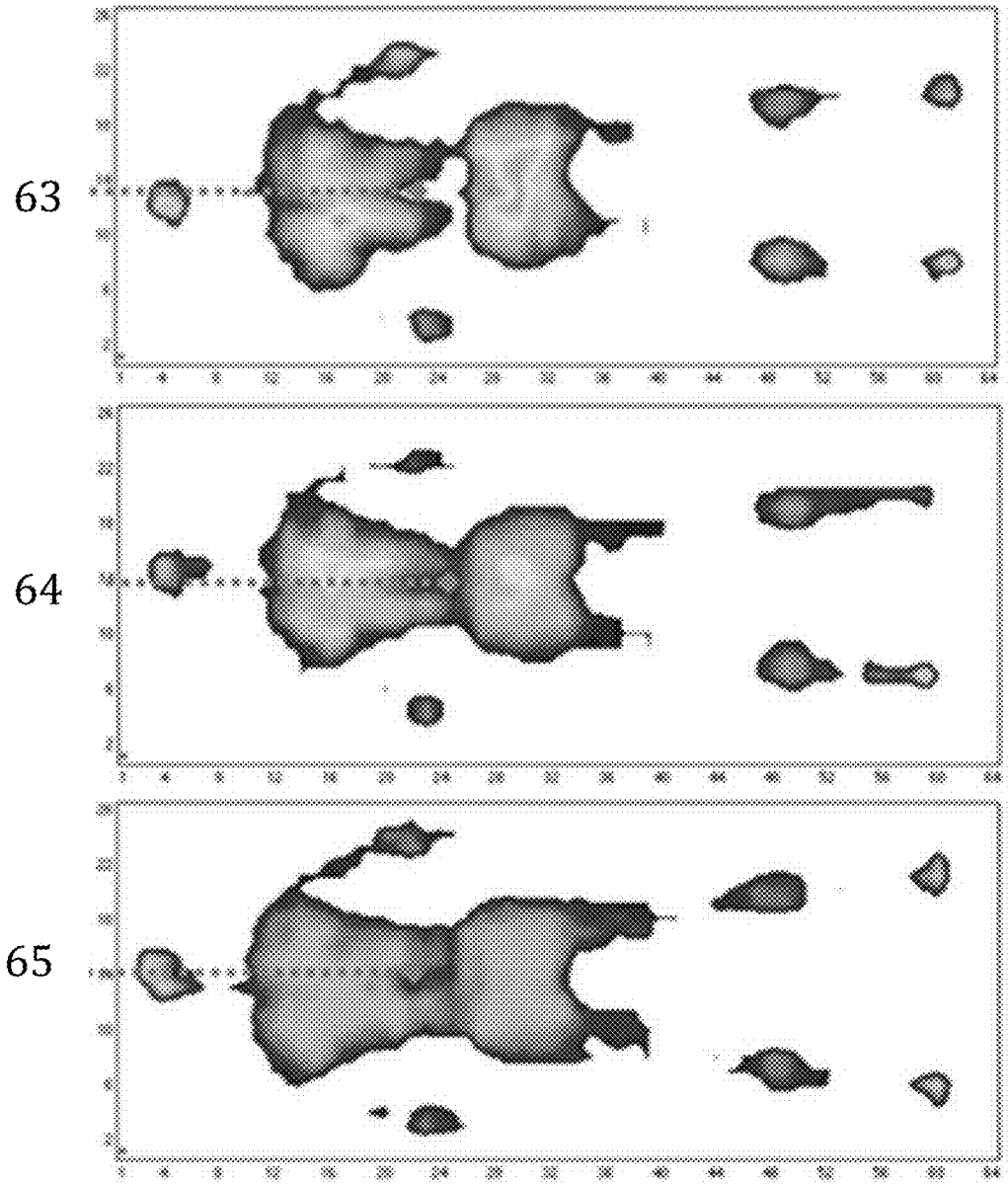
FIG. 15 is an example of pressure data for a mattress with decreasing firmness.

The bedding system can make automated adjustments to optimize the support and comfort attributes in response to the pressure sensor data. For example, pressure peaks and contact area can be derived from the pressure data and this information is used to automatically adjust the firmness of the support and comfort layers. An example of pressure images that correspond to mattress firmness in FIG. 15 demonstrates the visible differences in pressure data. A pressure image from a firm mattress (63) has higher peak pressures and lower contact area. An area of no pressure can be observed in the small of the back. A pressure image from a medium firm mattress (64) has reduced peak pressures, greater contact area, and improved contact in the small of the back. A pressure image from a soft mattress (65) has the lowest pressure peaks, the most even pressure distribution, the greatest contact area, and the greatest contact in the small of the back.

Figure 16A:
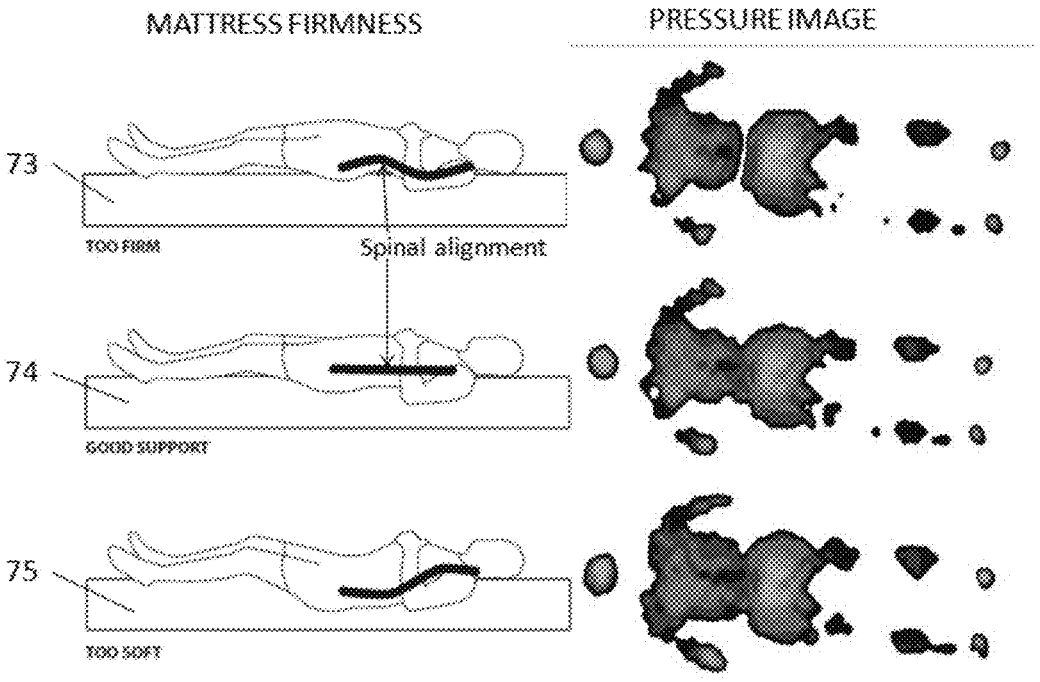
FIG. 16*a* illustrates spinal alignment for a back sleeper.

An example in FIG. 16*a* compares spinal alignment to mattress firmness and the corresponding pressure image. A too firm mattress (73) results in poor spinal alignment and the corresponding pressure image reveals lower contact area, higher peak pressures, and no contact in the small of the back. A mattress with good support (74) results in proper spinal alignment and the corresponding image shows lower peak pressures, a more even pressure distribution, increased contact area and good contact in the small of the back. A mattress that is too soft (75) also has poor spinal alignment but the pressure image has greater contact area and the most even pressure distribution. In this case the machine vision process (5) can compare the live pressure data to the optimal pressure data stored during the configuration of the bedding system and determine that the contact area for the too soft mattress (75) had exceeded the preferred contact area of the good support mattress.

Figure 16B:
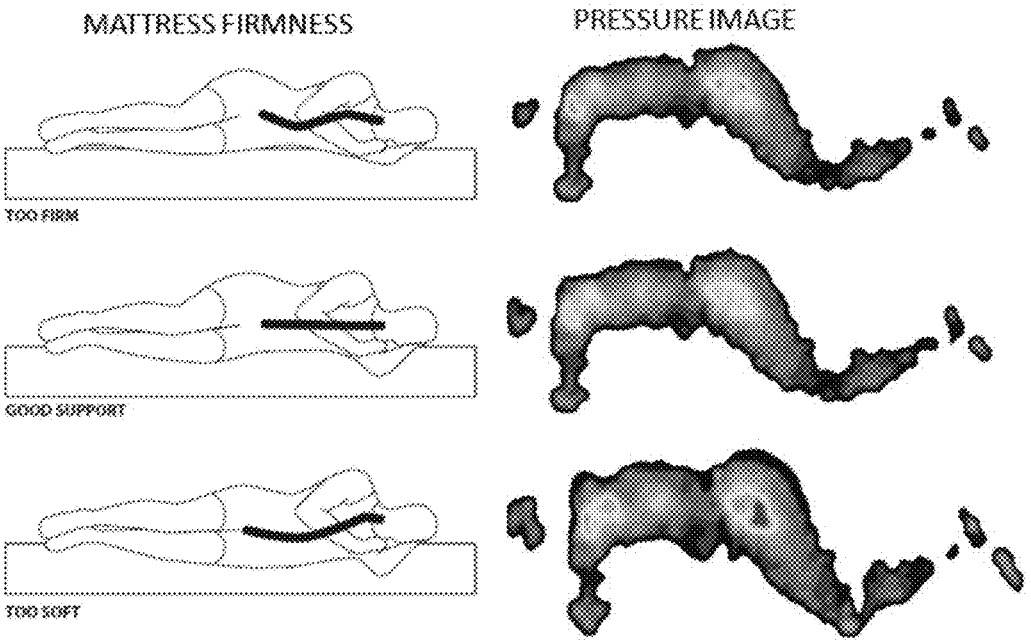
FIG. 16*b* illustrates spinal alignment for a slide sleeper.

FIG. 16*b* compares spinal alignment in the side sleeping position. As the mattress is adjusted from "too firm" to "good support," the peak pressures decreases and contact area increases. As the mattress is further adjusted to "too soft," the contact area continues to increase but peak pressures increase due to the person's body coming in contact with the hard base layer of the bedding system.

Firmness Optimization Technique.

Figure 17:
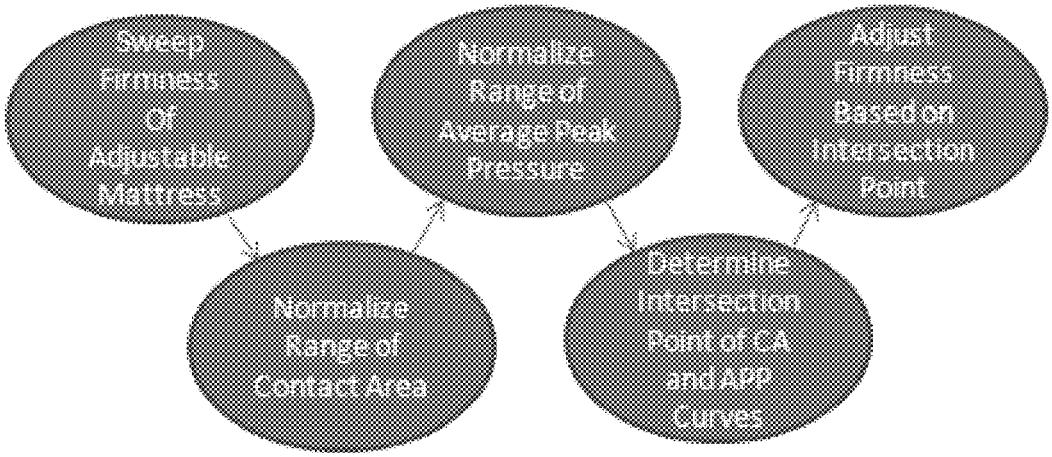
FIG. 17 is a flow diagram of a firmness optimization process.
Figure 18:
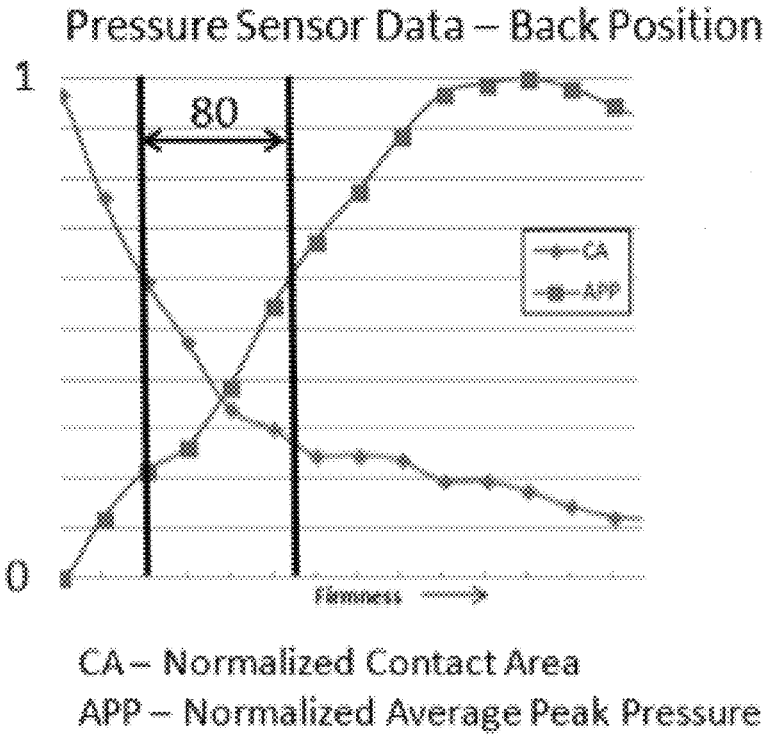
FIG. 18 is an example of a firmness optimization data derived from a pressure sensor dataset.

An example of a technique that can be used to optimize the firmness of the support layer of the adjustable mattress is provided in FIG. 17. To begin, the comfort and support engine (9) instructs the comfort adjustment system (17) to inflate all the bladders in the adjustable mattress (16) to maximum firmness. The comfort and support engine then slowly deflates the bladders to sweep the firmness from maximum to minimum while the pressure mapping engine (4) records pressure data throughout the sweep. The pressure data is further processed into contact area and average peak pressure values that are subsequently normalized by translating the data range to values between 0 and 1. The resulting normalized contact area and average peak pressure datasets are processed to determine the mattress firmness where the two datasets intersect. A graphical example of the contact area and average peak pressure datasets in FIG. 18 demonstrates that as the firmness of the mattress is decreased the contact area increases and the average peak pressure decreases. The zone where the two datasets intersect can be considered the zone of optimum firmness.

Further adjustments based on other support and comfort attributes can be made within a range (80) of the optimum firmness point. For example, if the air bladder pressure is swept from 2 pounds per square inch (PSI) to 0.1 PSI and the optimum firmness was found to be at a bladder pressure of 0.7 PSI then firmness adjustments could be made between +/−5% to +/−25% of full scale, or preferably 10% full scale.

Body Zones.

Figure 19:
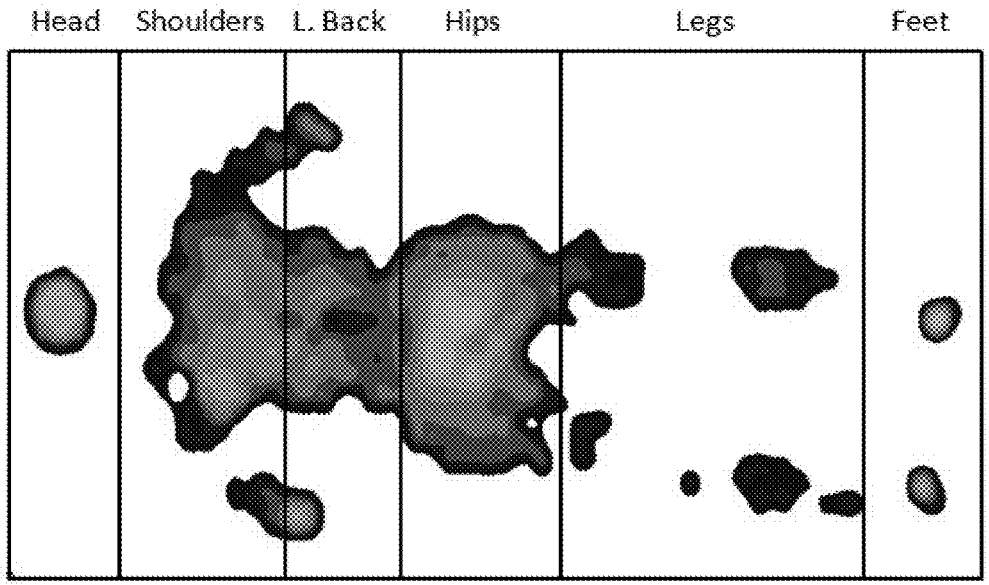
FIG. 19 is an example of a bedding system body zones.

Pressure measurements can also be subdivided into body zones or body areas to focus the automatic adjustment of the mattress firmness. For example, contact area could be calculated specifically in the lower back zone of a person's body, or peak pressures could be isolated to the shoulder and buttocks. The sensing area can be divided into 1 to 12 body zones, or preferably 6 zones isolating the head, shoulders, lower back, hips, legs and feet. An example of 6 body zones in FIG. 19 illustrates body zones of varying dimensions to align with the associated anatomical features.

In another example, the machine vision process (5) locates a person's body on the bedding system and automatically adjusts the body zones to align with the associated anatomical features.

Pressure data analysis within each body zone can be performed to evaluate the support and comfort attributes of the bedding system. For example, threshold pressure values may be used to determine a pressure distribution that compares the percentage of contact area that exceeds a high pressure threshold and the percentage of contact area that is below a low pressure threshold. Pressure distributions can be calculated for each body zone. Pressure distributions between body zones can also be compared. Optimum pressure distributions for each zone can be determined from the pressure data associated with the adjustable mattress settings stored during mattress configuration. Alternatively, the machine learning process (6) can select optimum pressure distributions based on pressure data that has resulted in the statistically determined best quality of sleep.

Figure 20:
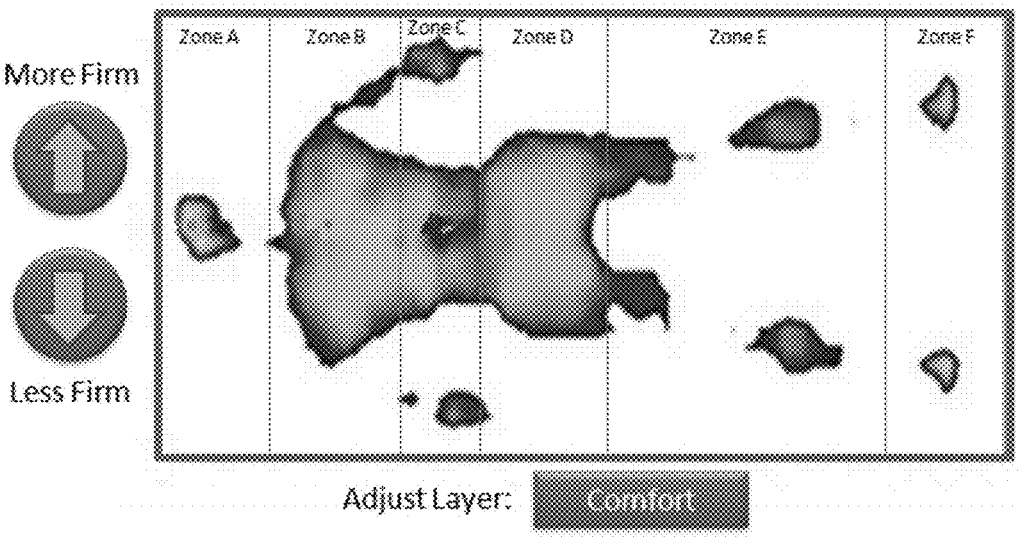
FIG. 20 is an example of a user interface for adjusting comfort and support.

In another example, the user interface (8) is used to allow a person to make manual adjustments to each zone in the adjustable mattress (16). An example of a zone adjusting user interface in FIG. 20 allows the user to manually adjust the mattress firmness in each body zone. The user interface allows the person to select either the support or comfort layers for adjustment. The preferred settings for each body zone are stored. The machine vision process (5) can determine the location of the body on the bedding system and communicate this to the comfort and support engine (9). The comfort and support engine can control the appropriate adjustable mattress bladders to align them with the body zones located with machine vision.

Machine Vision Methodologies

Identification

A Body Area and Position Identification Module (BAPIM) is responsible for identifying the body position (i.e., back, left side, or right side) as well as detecting certain body areas (e.g., hip, ischium, sacrum) from 2D sensor data received from the Plurality of Sensors Mat (PSM) device. The PSM system monitors interface pressure or other physical parameters on a bed. BAPIM allows the PSM system to determine a person's body position when lying on the sensor.

System Overview

Figure 21:
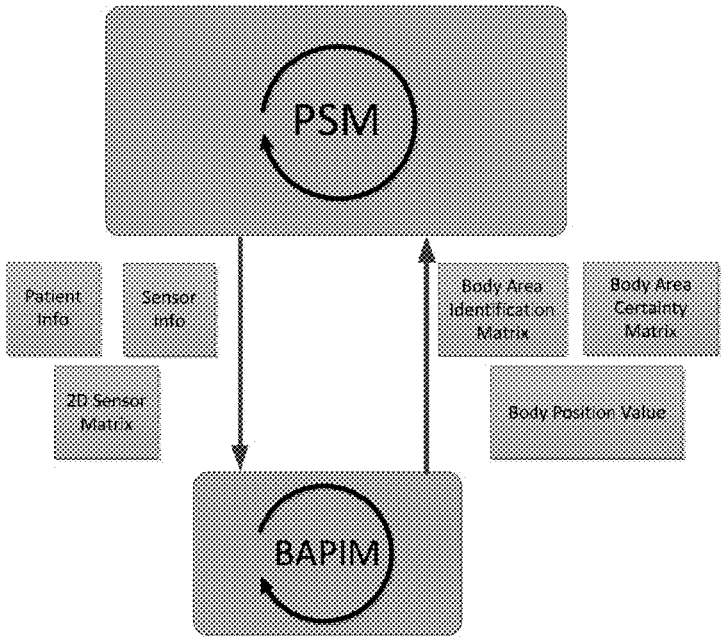
FIG. 21 illustrates one example of the interaction between PSM and BAPIM.

FIG. 21 illustrates one example of the interaction between PSM and BAPIM. In this example, each module has its own independent thread(s). PSM provides BAPIM with information about the sensor and the person on the bed (for instance, number of cells across the sensor length and width and the type or category of bed surface. To get body position identification results, PSM sends the sensor pressure readings as a 2D matrix to BAPIM. Once the analysis is complete, in this example, BAPIM provides a single value containing the predicted body position as well as two matrices: one containing the identified body areas and the other containing the certainty values for each of the identified pixels.

Figure 22:
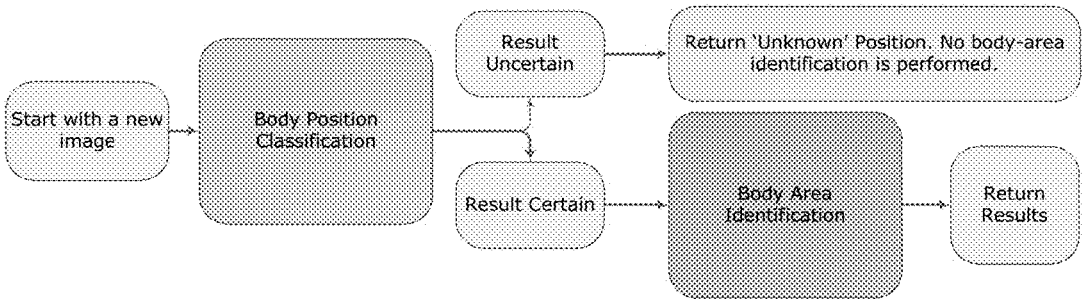
FIG. 22 shows an example process flow inside BAPIM.

FIG. 22 shows an example process flow inside BAPIM.

The module first attempts to predict the body position based on the sensor matrix. If the prediction likelihood is higher than a predetermined threshold, it will attempt to identify body areas for the predicted position. Otherwise, it will return 'unknown' for body position and no body-area identification is performed.

Dimensionality Reduction and Classification Methodology Overview

Body Position Classification Algorithm

In one approach, a combination of SVD projection and Logistic Regression is used for body position classification. SVD projection methods include SVD with nearest neighbor, shape-matching with k-prototypes, and Learning Vector Quantization, as well as ensemble methods.

Body Area Identification Algorithm

Shape-matching is based on a Shape-Contexts algorithm, introduced by Belongie and Malik. This method has been successfully applied for both object recognition and shape matching on a variety of image datasets. In particular, Mori and Malik use this method to estimate the body configuration and pose in three-dimensional space, based on single two-dimensional image containing a human body. A similar approach can be used for the body area identification problem in BAPIM.

Linear Algebra Library

The ALGLIB library for linear algebra operations is also used (singular value decomposition, matrix inversion, etc.) ALGLIB is a cross-platform numerical analysis and data processing library.

Interface with PSM and the Main Thread

This component contains the main thread of BAPIM, and is responsible for receiving data from PSM, preparing and sending data to the other components for analysis, and preparing the results to be sent back to PSM.

Figure 23:
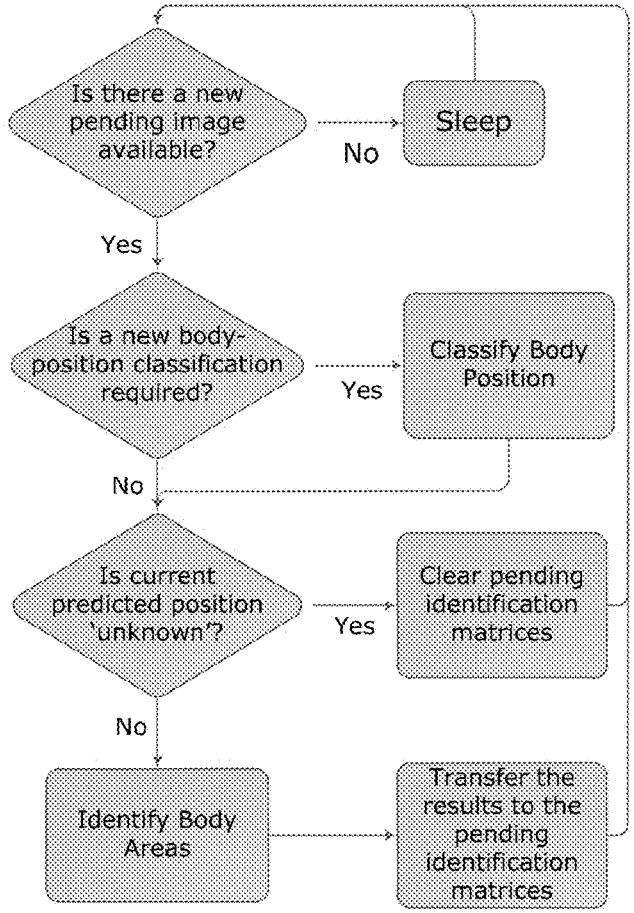
FIG. 23 illustrates an example program flow in the BAPIM main loop.

FIG. 23 illustrates the program flow in the main loop.

Figure 24:
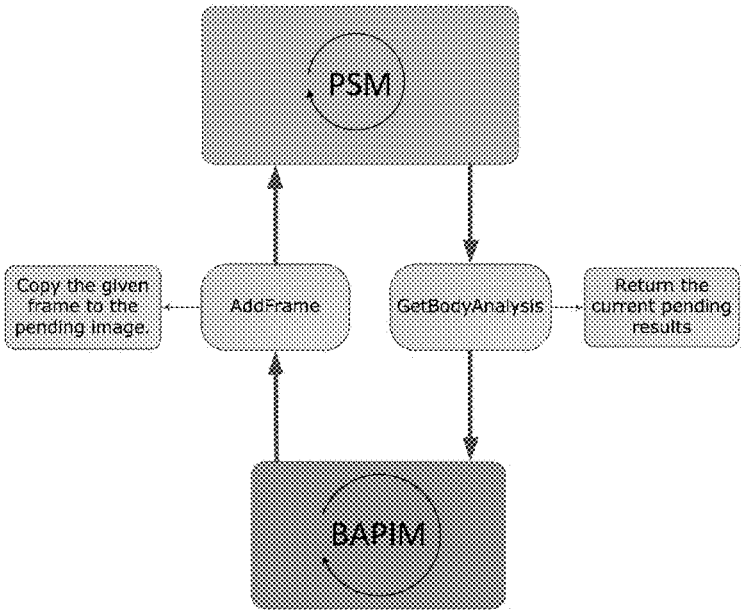
FIG. 24 illustrates BAPIM's main interactions with PSM.

BAPIM's main interactions with PSM are illustrated in FIG. 24.

Body Position Classification

Figure 25:
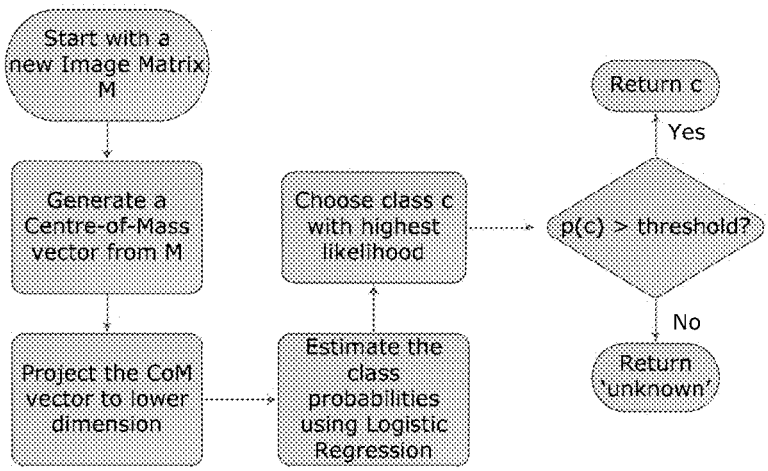
FIG. 25 illustrates body position classification flowchart.

See FIG. 25. This component is responsible for predicting the body position in a given sensor data matrix. In one approach, a feature vector is generated in two steps. First, the sensor image is divided into a number of horizontal bands, and for each band, the centre of mass is located. The resulting vector is then projected to a lower dimension. Finally, a previously learned logistic regression model is applied to the feature vector to generate a prediction.

Body Area Identification

Figure 26:
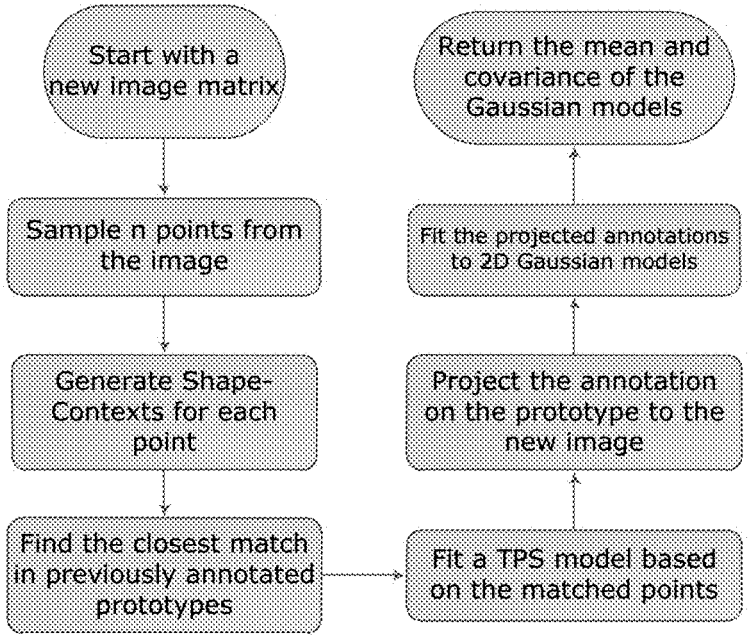
FIG. 26 illustrates body area identification flowchart.
Figure 27:
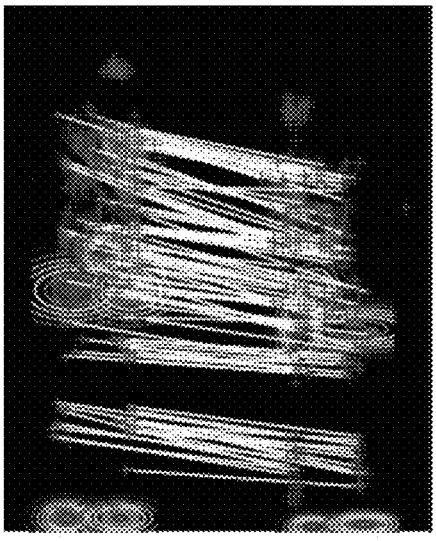
FIG. 27 presents a sample result for shape matching and TPS annotation projection.

This component is responsible for identifying body areas based on the current body position prediction. An overview of the process is illustrated in FIG. 26. FIG. 27 presents a sample result for shape matching and TPS annotation projection. The image on the left is the original annotated prototype, and the image on the right is the new image that needs to be annotated. The circles represent the sampled points on each image. The lines show the matches found based on the generated shape-contexts. The Gaussian distributions represent original annotated body areas on the left image, and the projected body-areas on the right image.

Search Based Methodology Overview

Body Templates

Figure 28:
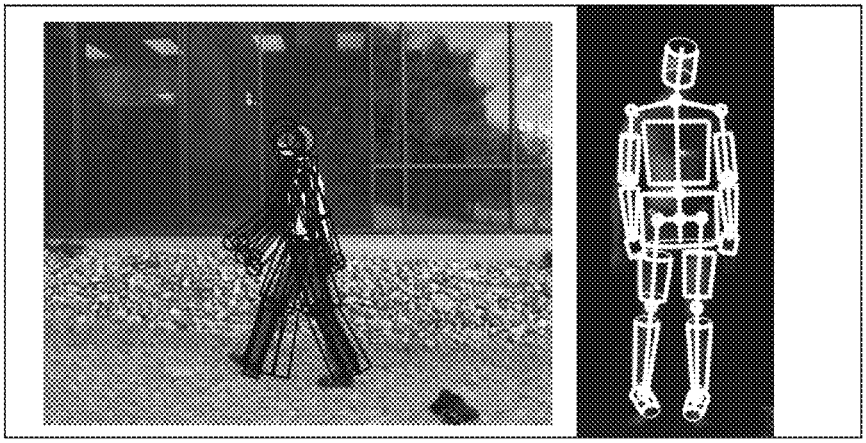
FIG. 28 shows two examples of a human body template.

A human body is represented as 2D or 3D templates, consisting of rigid body segments and joints that connect them (see FIG. 28). Each joint has a predefined degree of freedom. If sizes of the body segments are known, a body template with n joints can then be represented with a vector of parameter values $[x_0, y_0, \Theta_0, \Theta_1, \ldots \Theta_n]$ where $x_0$, $y_0$ determine the location of the centre of the template, and $\Theta_1$ to $\Theta_n$ determine the angle of each joint.

Fitness Function

The fitness function determines how well a given body template matches the current image. A template that matches exactly on all body segments should receive a high fitness value, while a poorly matched template should receive a low score. A simple version of this function only considers the image intensity, while more complex versions can include edge detection and other image processing methods.

Search

Once we are able to draw a template from a given parameter vector $[x_0, y_0, \Theta_0, \Theta_1, \ldots, \Theta_n]$ and calculate the fitness of this template to the current frame, we can reduce the body pose estimation problem to a search problem by assuming that all location and degree values are discrete. Among all possible (and finite) templates, we would like to find the template with the highest fitness value. If the size of body is not known, the search is also expanded over a set of predefined body sizes. Depending on the number of degrees of freedom in the body template and the time allowed, this could be done through as a simple brute-force search, or may require much more complex methods, such as particle filtering.

Body Position Detection via Multiple Template Search

Figure 29:
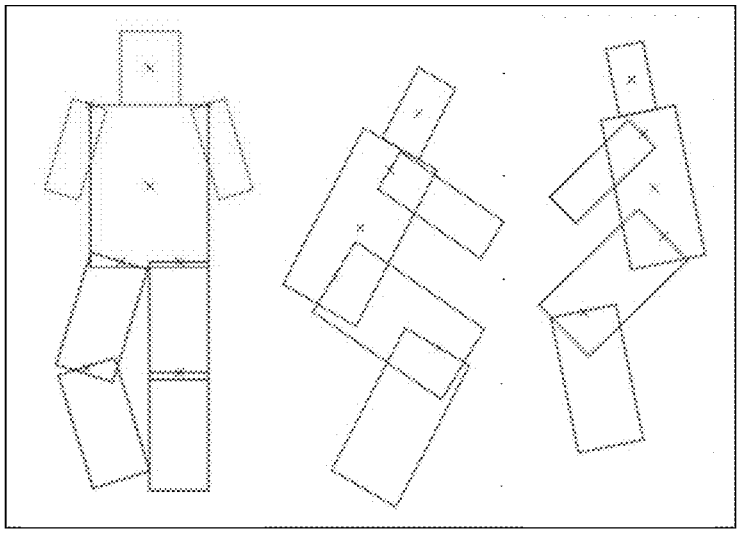
FIG. 29 shows sample body templates for back, left and right body positions.

In BAPIM, we predict the position of the body (left, right, back) in the current frame. One method is to generate a separate 2D body template for each position, as illustrated in FIG. 29:

For each new frame, we search for the best back, left, and right templates. We then compare these three best matches, and the template with the highest fitness value is the prediction for the body position in the given frame.

Search Based Methodology Breakdown

Search has the following aspects:

1. Generate Articulated Body Templates

Given a parameter vector $[x_0, y_0, \Theta_0, \Theta_1, \ldots, \Theta_n]$ generate and render the corresponding kinetic tree. The implementation preferably is flexible to easily allow addition of new body segments.

2. Fitness Functions

A good fitness function is important for reaching a high predictive accuracy. In one approach, we can only look at pressure intensity, and define fitness as how much of the pressure is covered by a given template. More complex approaches can also combine fitness score based on edge detection, centre-of-mass, and other image processing techniques.

3. Fast (Near Real-Time) Search Process

Since we are only interested in determining the overall position of the body, and not the fine configuration of each segment, our templates can have much fewer degrees of freedom compared to other approaches. As such, a simple brute-force search that covers all possible configurations of all body templates may be sufficient in some implementations. If needed, various performance optimization techniques may make the search fast enough for near real-time performance. More complex search techniques, such as particle filtering or UCT, can also be used.

4. Enhance the Position Detection Through Segment Specific Classifiers

Figure 30:
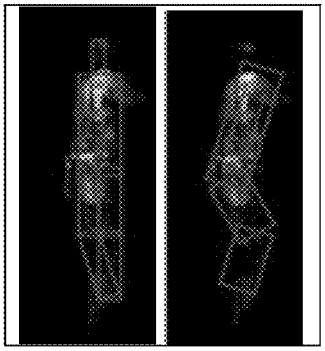
FIG. 30 shows two templates matching a body.

In the case when we do not know the body size, or when the width and the depth of the body are close, a larger side template and a smaller back template may both fit certain body positions, as illustrated in FIG. 30:

To overcome this problem, we can use segment specific classifiers. For instance, one classifier determines how likely it is for the segment inside the "back upper body box" to belong to that section. A separate classifier determines the likelihood of the "left upper body box". The separate predictions are then combined to determine which template better matches the body.

5. Incorporate Sequence Data Through a Probabilistic Model

The four steps above deal with finding the body position in a single frame. Using a probabilistic model to include information about the sequence of frames can potentially give us more robust predictions. Basically, at each time step the model has a probabilistic 'belief' of possible body sizes and positions that the person can be in. Given a new frame, the model then updates its belief, based on how well each template type matches the new frame and also how likely the transition between previous state and current state is. For instance, if the model believed (with a high probability) that the body was in a left position in the previous frame, and in the current frame it needs to decide between equally likely left and a right positions, it will pick the left position, since it is very unlikely for the body to jump from left to right in a single frame.

Medial Axis and Line Segmentation Methodology Overview

Figure 31:
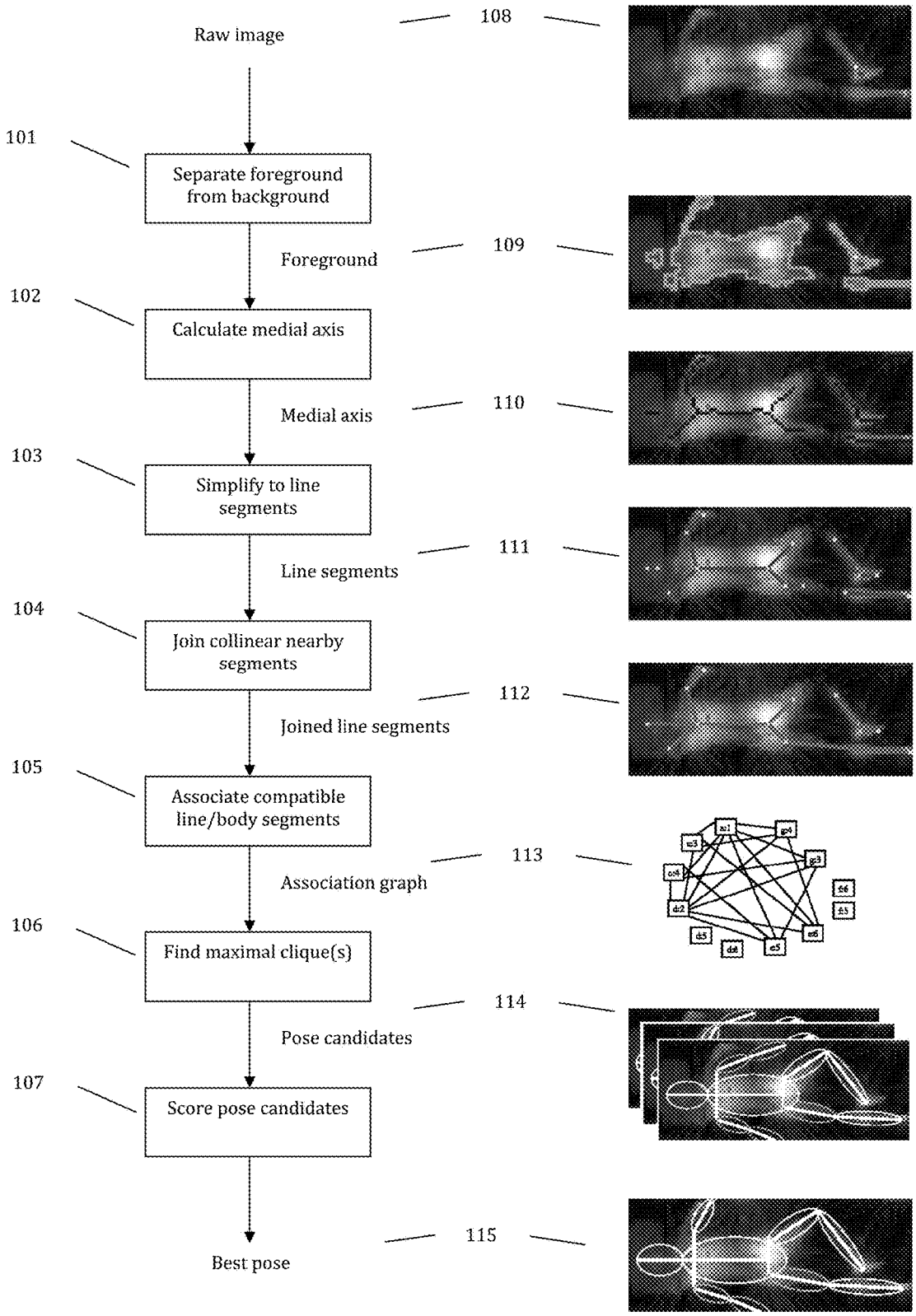
FIG. 31 shows an overview of an example method for automatically estimating the articulated body pose from a pressure imaging system and example intermediate outputs for each step in the method.

The medial axis and line segmentation methodology is one approach for reliably, quickly and automatically estimating the articulated body pose from a pressure imaging system. In one implementation, the method uses the following steps. Each of these is described in more detail below.

a) Separating foreground information in the image from background information in the image to produce a binary foreground image
b) Calculating the medial axis of the binary foreground image
c) Simplifying the medial axis into straight line segments
d) Joining collinear nearby straight line segments
e) Associating joined straight line segments with all possible compatible body segments in an association graph
f) Finding the maximal clique(s) of the association graph to produce one or more pose candidates
g) Scoring the pose candidates and outputting the candidate with the highest score FIG. 31 shows an overview of an example method for automatically estimating the articulated body pose from a pressure imaging system. Element 108 represents an example of the raw image output from the pressure imaging system. This image consists of a 2 dimensional array of pixels, one for each sensel, with brighter pixels representing higher pressure.

Separating Foreground From Background

Figure 32:
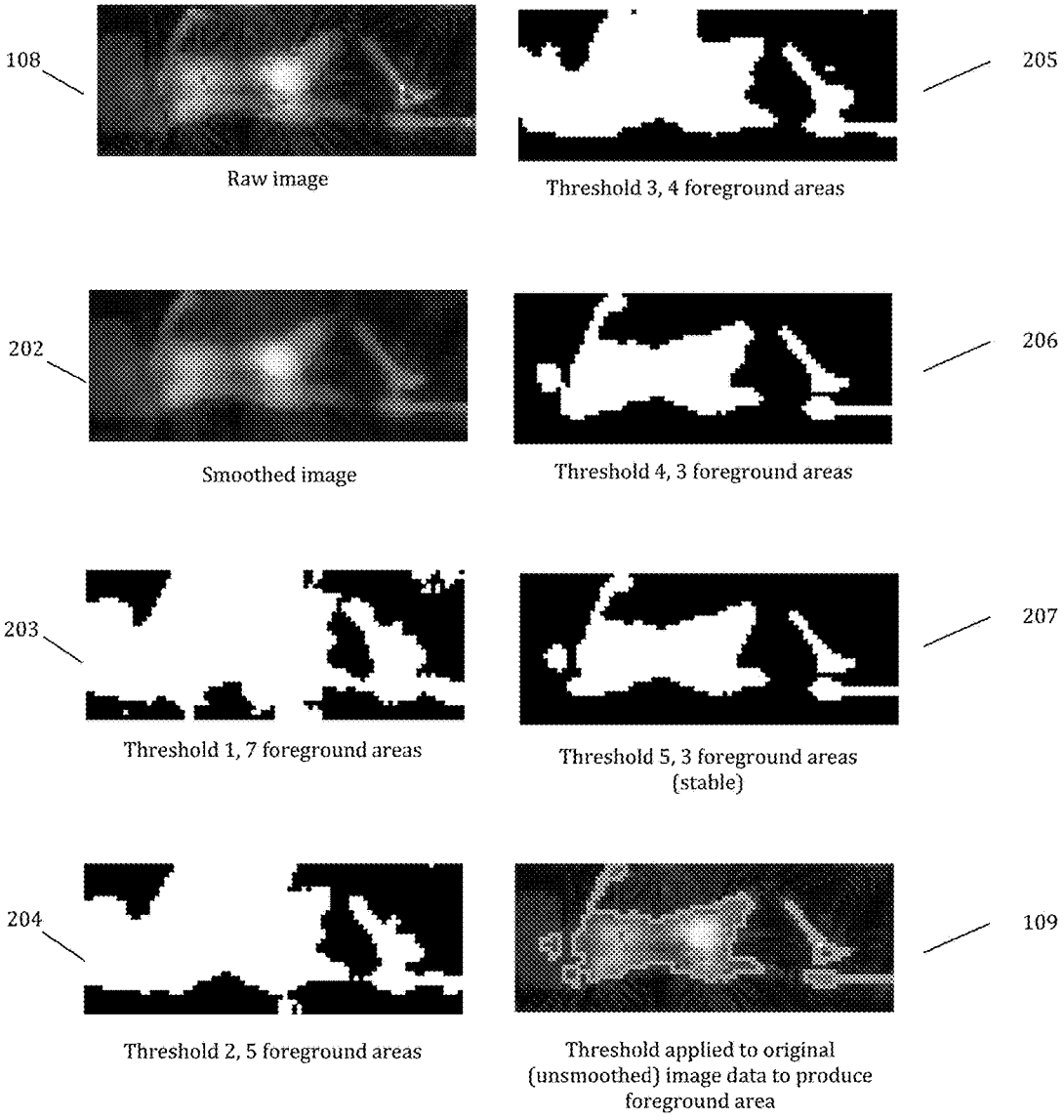
FIG. 32 shows example intermediate outputs for steps in the method for separating the foreground information from the background information to produce a binary foreground image.

The raw image is input to step 101 in FIG. 31, which separates foreground from background. FIG. 32 shows an example of this step in more detail. The raw image is first smoothed to reduce noise (element 202). The smoothed image is then separated into foreground and background by applying progressively higher grey level thresholds. At each threshold the number of foreground areas is counted. As the threshold increases, the number of foreground areas decreases (elements 203, 204, 205, 206, 207). The best foreground/background separation is determined to be when the number of foreground areas stabilizes (stops decreasing). Once the threshold has been determined, the smoothed image is discarded and the threshold is applied to the original image to produce the foreground area (outlined in green in element 109). The original image is used in preference to the smoothed image at this step in order to preserve as much detail as possible from the original raw image for subsequent steps. The smoothed image is used only for determining the optimal threshold.

Calculating the Medial Axis

Step 102 in FIG. 31 calculates the medial axis of the foreground area. Medial axis calculation is the process of removing successive layers from the outside edges of the foreground area, stopping the process wherever two edges meet each other. FIG. 33 shows an example of this step in more detail. The foreground area (element 109) from the previous step is used as a starting image. After one iteration of medial axis calculation the image is reduced to that shown in element 301. The process continues with more layers removed at each iteration. Element 302 shows the image after 3 iterations for the given example image. Element 204 shows the image after 5 iterations for the given example image. It is determined that further iterations have no effect for the given example image. This terminates the medial axis calculation. Element 110 shows the calculated medial axis overlaid on the original raw image.

Simplifying to Line Segments

Step 103 in FIG. 31 simplifies the medial axis into straight line segments. FIG. 34 shows an example of this step in more detail. First the medial axis is broken into constituent curves radiating from each junction point. In the example shown, the medial axis consists of only one curve (the curved line in element 401). A straight line segment is drawn from start to end of the curve (the straight line in element 401). If the point on the curve which is furthest from the straight line segment exceeds a maximum allowable distance, the straight line is broken into two line segments at that point on the curve (shown in element 402). This process continues until there is no point on any curve which exceeds the maximum distance. Elements 403, 404 and 405 show intermediate steps for the given example. At the step shown in element 405, it is determined that every point on the medial axis is within the maximum allowable distance. This terminates the simplification to line segments.

Joining Collinear Nearby Segments

Step 104 in FIG. 31 joins collinear nearby segments. FIG. 35 shows an example of this step in more detail. The original line segments are depicted in element 111. Each line segment is compared with each other line segment. If the two line segments are collinear or nearly collinear and the segment end points are near to each other, it is assumed that the two smaller line segments represent parts of a larger body segment, and these two line segments are simplified to a single line segment. This process is repeated until no more collinear nearby segments can be found, and the process terminates. Element 112 in FIG. 35 shows two pink line segments, one representing a leg, one representing an arm, which have been formed by joining smaller segments with this process.

Association of Compatible Line/Body Segments

Step 105 in FIG. 31 constructs an association graph, which represents which line segments and body segments are compatible with each other. The vertices represent potential body segment interpretations for a particular line segment, and the edges represent compatible body segments pairs. In the example shown in element 113 of FIG. 36 (prior art), the numbers [1-6] can be thought of as detected line segments, and the letters [a-g] can be thought of as possible body segments (torso, upper arm, lower leg etc.).

The rules used to construct the vertices relate to the expected size and position of body segments. For example, for a line segment to be considered as a potential forearm (green arrows in Element 601), one set of rules might be:

- have an origin within the left hand 40% of the image (assuming the head is to the left)
- be at least 5% of the body height in length
- be no more than 21% of the body height in length
- be within feasible movement range from the previously determined forearm position As another example, for a line segment to be considered as a potential lower leg, one set of rules might be:

- have an origin at least 30% from the left of the image
- have an origin no more than 90% from the left of the image
- be at least 8% of body height in length
- be no more than 31% of body height in length
- be within feasible movement range from the previously determined lower leg position The rules used to construct the vertices relate to the expected relative positions and angles of the two body segments. For example, for a forearm to be compatible with an upper arm, one set of rules might be:

- have a different origin to the upper arm (if they are both left or both right)
- have an origin in proximity to the end of the upper arm (if they are both left or both right)
- have an origin a minimum distance from the upper arm origin (if one is left and one is right)
- have an origin a maximum distance from the upper arm origin (if one is left and one is right)

As another example, for a torso to be compatible with a lower leg, one set of rules might be:

- have a different endpoint to the origin of the lower leg
- have a different origin to the lower leg
- be a minimum distance from the origin of the lower leg
- be a maximum distance from the origin of the lower leg
- have a direction within 90 degrees of the direction of the lower leg The above rules are merely examples and the complete set of rules for constructing the association graph may comprise hundreds of such rules.

Creation of Pose Candidates

Step 106 in FIG. 31 calculates the biggest complete sub-graph(s) (maximal clique(s)) in the association graph. Each maximal clique represents an association of line segments to body segments. For each maximal clique, 4 potential pose hypotheses are created for each of the four basic poses—supine (lying on back), prone (lying on front), left lateral (lying on left side) and right lateral (lying on right side). Starting with the torso, gray data from the original raw image is used to fine adjust the position and angle of each body segment. The length is normalized based on the expected length of that segment, as determined from the known height of the person entered by an operator and the standard body proportions. Rules are used to deduce missing body segments when no corresponding line segment is included, for example, when deducing the location of an upper leg:

- choose a start point based on the torso position, and whether or not this is a lateral pose
- if a corresponding line segment was supplied as part of the pose candidate, do a best fit to the line segment
- otherwise, if the corresponding lower leg is supplied, project towards the start position of the lower leg
- otherwise, if the corresponding foot is supplied, deduce the knee location and project towards the knee
- otherwise, if this is a lateral pose and the other leg position can be deduced, put the leg in the same position
- otherwise, put the leg in a default position The output of this step is a set of pose candidates as represented by element 114 in FIG. 31.

Scoring Pose Candidates

Step 107 in FIG. 31 generates a percentage score for each pose candidate. Not all pose candidates are valid and need to be scored—many can be immediately rejected based on infeasible combinations of joint angles (joint angle terminology is shown in element 701 in FIG. 37). For example, the rules for the hip joint angles might be:

- if the hip joint abducts more than 45 degrees, reject
- if the hip joint adducts more than 25 degrees, reject
- if the hip joint flexes more than 115 degrees, reject
- if the hip joint is hyper-extended more than 30 degrees, reject Any remaining pose candidates are then initially scored based on how well the line segments match the adjusted body segments. The score is then reduced based on the number and size of any leftover/unmatched line segments. The score is then reduced further for body segment configurations that are feasible but unlikely, for example, the rules for lower legs might be:

if a lower leg crosses an upper leg, reduce the score if a left lower leg is connected directly to a right upper leg (or vice versa), reduce the score The score is then reduced further for gray data which does not support the pose hypothesis. For example, the rules for the gray data in the areas on either side of the coccyx might be:

if this is a lateral pose (element 704 in FIG. 37 depicts an example) and the brightness in either of these areas is more than 2.5 times the image mean, reduce the score if this is a supine pose (element 702 in FIG. 37 depicts an example) and the brightness in either of these areas is less than 2.5 times the image mean, reduce the score if this is a prone pose (element 703 in FIG. 37 depicts an example) and the brightness in either of these areas is less than 1.5 times the image mean, reduce the score The pose candidate with the highest score is returned as an estimated body pose (element 115 in FIG. 31), comprising a set of start/end positions for each body segment.

What is claimed is:

1. A method for automatically adjusting a bedding system for a sleeper who is sleeping on the bedding system, the method comprising:

measuring, by a pressure mapping engine, a two-dimensional pressure image of the sleeper on the bedding system while the sleeper is sleeping on the bedding system;

applying a machine vision process to analyze the pressure image to determine a position classification for a body position of the sleeper, comprising:

identifying body parts of the sleeper from the pressure image;

determining a position of the body parts relative to each other on the pressure image; and selecting a position classification for the body position of the sleeper, the position classification selected from a set of predetermined position classifications, the selection made based on the position of the body parts relative to each other;

providing the position classification to a comfort and support engine; and while the sleeper is sleeping on the bedding system, adjusting, by the comfort and support engine, a comfort and/or support of the bedding system based at least in part on the position classification.

2. The method of claim 1 wherein the set of predetermined position classifications includes a leftside-sleeping classification, a rightside-sleeping classification, and a back-sleeping classification.

3. The method of claim 1 wherein the step of applying a machine vision process comprises applying a machine vision process to the pressure image to determine the sleeper's sleep state; and the step of adjusting a comfort and/or support of the bedding system comprises adjusting a comfort and/or support of the bedding system based on a sleep state of the sleeper.

4. The method of claim 3 wherein the step of applying a machine vision process comprises applying a machine vision process to the pressure image to select the sleeper's sleep state from a predefined set of possible sleep states that include at least one of: bed entry, deep sleep, restless motion, morning wake up and bed exit.

5. The method of claim 3 wherein the step of applying a machine vision process comprises applying a machine vision process to the pressure image to select the sleeper's sleep state from a predefined set of possible sleep states that include at least one of the accepted standard five stages of sleep.

6. The method of claim 1 wherein the step of adjusting a comfort and/or support of the bedding system comprises adjusting both a comfort and a support of the bedding system.

7. The method of claim 1 wherein the bedding system comprises a comfort layer and a support layer and the step of adjusting a comfort and/or support of the bedding system comprises adjusting both the comfort layer and the support layer of the bedding system.

8. The method of claim 1 wherein the step of adjusting a comfort and/or support of the bedding system comprises creating a travelling wave of pressure across the bedding system.

9. The method of claim 1 further comprising:

measuring a temperature of the bedding system while the sleeper is sleeping on the bedding system; and adjusting the temperature of the bedding system based on the measured temperature.

10. The method of claim 9 wherein the bedding system comprises thermal zones that are separately adjustable, and the step of adjusting the temperature of the bedding system comprises adjusting a temperature of a thermal zone corresponding to a location of the sleeper's hands and/or feet.

11. The method of claim 1 further comprising:

measuring a moisture of the bedding system while the sleeper is sleeping on the bedding system; and adjusting an airflow of the bedding system based on the measured moisture.

12. The method of claim 1 further comprising:

measuring a moisture of the bedding system while the sleeper is sleeping on the bedding system; and adjusting a temperature of the bedding system based on the measured moisture.

13. The method of claim 1 wherein the bedding system comprises zones that are separately adjustable, and the step of adjusting a comfort and/or support of the bedding system comprises adjusting a comfort and/or support of the zones based on the analysis of the machine vision process.

14. The method of claim 13 wherein the step of adjusting a comfort and/or support of the zones comprises:

determining a location of the sleeper's hands and/or feet based on the analysis of the machine vision process; and adjusting a comfort and/or support attribute of a zone of the zones corresponding to a location of the sleeper's hands and/or feet.

15. The method of claim 1, wherein the bedding system comprises a pillow, and the method further comprises:

adjusting a height of the pillow based on the analysis of the machine vision process.

16. The method of claim 1 wherein the step of adjusting a comfort and/or support of the bedding system results in a reduced peak pressure in the measured pressure image.

17. The method of claim 1 wherein the step of adjusting a comfort and/or support of the bedding system changes an alignment of the sleeper's spine.

18. The method of claim 1 wherein the step of adjusting a comfort and/or support of the bedding system comprises selecting one of a set of preselected settings for the bedding system based on the analysis of the machine vision process.

19. The method of claim 18 wherein the preselected settings are customized for the sleeper.

20. The method of claim 18 wherein different preselected settings are customized for different sleepers.

21. The method of claim 18 wherein the step of selecting one of a set of preselected settings for the bedding system comprises:

selecting one of the set of preselected settings for the bedding system based on the body position of the sleeper.

22. The method of claim 1 further comprising:

sensing a shape of the sleeper on the bedding system while the sleeper is sleeping on the bedding system; and while the sleeper is sleeping on the bedding system, adjusting the comfort and/or support of the bedding system based on the sensed shape.

23. The method of claim 1 wherein the step of adjusting a comfort and/or support of the bedding system comprises adjusting a firmness of the bedding system relative to an optimum firmness defined as a firmness where a normalized contact area of the pressure image is equal to a normalized average peak pressure of the pressure image.

24. A comfort and support control system for automatically adjusting a bedding system for a sleeper who is sleeping on the bedding system, comprising:

a pressure mapping engine that measures a two-dimensional pressure image of the sleeper on the bedding system while the sleeper is sleeping on the bedding system;

a machine vision process that analyzes the pressure image to determine a position classification for a body position of the sleeper, comprising:

identifying body parts of the sleeper from the pressure image;

determining a position of the body parts relative to each other on the pressure image; and selecting a position classification for the body position of the sleeper, the position classification selected from a set of predetermined position classifications, the selection made based on the position of the body parts relative to each other;

providing the position classification to a comfort and support engine; and the comfort and support engine that, while the sleeper is sleeping on the bedding system, adjusts a comfort and/or support of the bedding system based at least in part on the position classification.

25. The method of claim 1, further comprising:

over a period of nights:

monitoring a pressure distribution of the sleeper on the bedding system while the sleeper is sleeping on the bedding system; and adjusting, by the comfort and support engine, the comfort and/or support of the bedding system based on changes in the monitored pressure distribution over the period of nights.

26. The method of claim 25 wherein the step of adjusting the comfort and/or support of the bedding system comprises:

quantifying a movement of the sleeper based on the monitored pressure distributions; and adjusting the comfort and/or support to reduce the sleeper's movement.

27. The method of claim 1, wherein the machine vision process comprises:

calculating a medial axis of the pressure image, the medial axis including a set of line segments;

associating the set of line segments with a set of body parts;

determining, from the set of predetermined position classifications, a set of candidate predetermined position classifications based on the association between the set of line segments and the set of body parts;

for each candidate predetermined position classification: determining a quality score of the candidate predetermined position classification based on a matching between the set of line segments and the set of body parts; and selecting a candidate position classification with a highest quality score as the position classification for the body position of the sleeper.

* * * * *